United States Patent [19]

Ohki et al.

[11] Patent Number: 4,717,651

[45] Date of Patent: Jan. 5, 1988

[54] COLOR PHOTOGRAPHIC LIGHT-SENSITIVE MATERIAL

[75] Inventors: Nobutaka Ohki; Yoshinobu Yoshida, both of Kanagawa, Japan

[73] Assignee: Fuji Photo Film Co., Ltd., Kanagawa, Japan

[21] Appl. No.: 18,737

[22] Filed: Feb. 24, 1987

Related U.S. Application Data

[63] Continuation of Ser. No. 861,104, May 6, 1986, abandoned, which is a continuation of Ser. No. 600,671, Apr. 16, 1984, abandoned.

[30] Foreign Application Priority Data

Apr. 15, 1983 [JP] Japan ..... 58-66630
May 10, 1983 [JP] Japan ..... 58-81523

[51] Int. Cl.[4] ..... G03C 1/34; G03C 1/40; G03C 7/26; G03C 7/40

[52] U.S. Cl. ..... 430/551; 430/372; 430/381; 430/548; 430/552; 430/553

[58] Field of Search ..... 430/372, 381, 548, 552, 430/553, 551

[56] References Cited

U.S. PATENT DOCUMENTS

| | | | |
|---|---|---|---|
| 3,767,412 | 10/1973 | Monbaliu et al. | 430/548 X |
| 4,013,635 | 3/1977 | Landholm et al. | 430/225 X |
| 4,205,987 | 6/1980 | Erikson et al. | 430/216 |
| 4,277,558 | 7/1981 | Kikuchi et al. | 430/372 X |
| 4,294,918 | 10/1981 | Yagihara et al. | 430/553 |
| 4,334,011 | 6/1982 | Aoki et al. | 430/553 X |
| 4,345,025 | 8/1982 | Yagihara et al. | 430/553 X |
| 4,447,523 | 5/1984 | Ross et al. | 430/551 X |

OTHER PUBLICATIONS

W. H. Faul., 4-Sulfoamidonaphtha Covered Coupler, Research Disclosure, No. 134, p. 46, Jun. 1975.

*Primary Examiner*—John E. Kittle
*Assistant Examiner*—Mukund J. Shah
*Attorney, Agent, or Firm*—Sughrue, Mion, Zinn, Macpeak & Seas

[57] ABSTRACT

A silver halide color photographic light-sensitive material is disclosed, containing: (1) a compound containing two units selected from the group represented by general formula (I) or (II) in the molecule, or (2) a polymer containing a group represented by general formula (I) or (II) as a pendant.

Formula (I)

Formula (II)

wherein $R^1$, $R^2$, $R^3$, A, B and Q are defined herein. This compound or polymer functions as a color stain inhibitor in the light-sensitive material and provides various advantages; for example, it can efficiently remove the oxidized products of color developing agents, it can be used in light-sensitive materials reduced in thickness, and it is not subject to change in performance even after a long-term storage.

4 Claims, No Drawings

COLOR PHOTOGRAPHIC LIGHT-SENSITIVE MATERIAL

This is a continuation of application Ser. No. 861,104, filed 5/6/86, now abandoned, which is a continuation of application Ser. No. 600,671, filed 4/16/84, now abandoned.

FIELD OF THE INVENTION

The present invention relates to a color photographic light-sensitive material which is prevented from color staining. More particularly, it is concerned with a silver halide color photographic light-sensitive material containing sulfonamidophenol derivatives as color stain inhibitors.

BACKGROUND OF THE INVENTION

It is well known that in multi-layer color photographic light-sensitive materials of the type that a silver halide photographic light-sensitive emulsion contains a color-forming coupler and development is performed using color developing agents such as paraphenylenediamine, an oxidized color developing agent formed at the time of the development transfers into the adjacent image-forming layer, causing the phenomenon of "color turbidity or color mixing", i.e., the formation of undesirable dyes. It is also known that at the time of color development the undesirable phenomenon of "color fog" is caused to occur by air oxidation of the developing agent, fog of the emulsion, and so forth.

The term "color stain" is used herein to include both the "color turbidity" and "color fog" as described above.

In order to prevent color stain, it has been proposed to use hydroquinones. Thus, various hydroquinones have heretofore been known, including mono-straight chain alkylhydroquinones as described in U.S. Pat. No. 2,728,659 and Japanese Patent Application (OPI) No. 106329/74 (the term "OPI" as used herein means a "published unexamined Japanese patent application"), mono-branched chain alkylhydroquinones as described in U.S. Pat. No. 3,700,453, West German Patent Laid-Open No. 2,149,789, and Japanese Patent Application (OPI) Nos. 156438/75 and 106329/74, di-straight chain alkylhydroquinones as described in U.S. Pat. Nos. 2,728,659 and 2,732,300, British Pat. Nos. 752,146 and 1,086,208, and *Chemical Abstract*, vol. 58, 6367h, and di-branched chain alkylhydroquinones as described in U.S. Pat. Nos. 3,700,453 and 2,732,300, British Pat. No. 1,086,208, *Chemical Abstract*, vol. 58, 6367h, Japanese Patent Application (OPI) No. 156438/75, and Japanese Patent Publication Nos. 21249/75 and 40818/81.

The use of alkylhydroquinones as color stain inhibitors is described also in British Pat. Nos. 558,258, 557,750 (corresponding to U.S. Pat. No. 2,360,290) and 557,802, 731,301 (corresponding to U.S. Pat. No. 2,701,197), U.S. Pat. Nos. 2,336,327, 2,403,721 and 3,582,333, West German Patent Laid-Open No. 2,505,016 (corresponding to Japanese Patent Application (OPI) No. 110337/75), and Japanese Patent Publication No. 40816/81.

It is known that even in color diffusion transfer photographic light-sensitive materials, the "color turbidity" phenomenon occurs as in the usual color photographic light-sensitive material. In order to prevent this phenomenon, hydroquinones as described above are utilized. For example, hydroquinones which are used as color turbidity inhibitors in the diffusion transfer light-sensitive materials are described in Japanese Patent Application (OPI) No. 21249/83.

Sulfonamidophenols can also be used as color turbidity inhibitors for the diffusion transfer light-sensitive materials, as described in *Research Disclosure*, 15162 (1973), page 83, Japanese Patent Application (OP) Nos. 72158/80 and 24941/82 (corresponding to U.S. Pat. No. 4,366,226).

In recent production of color photographic light-sensitive materials, to obtain higher quality color photographs, it has been strongly desired to develop new color stain inhibitors which (1) are able to more efficiently prevent color stain without causing a reduction in photographic sensitivity, (2) can be used in light-sensitive materials reduced in thickness for the purpose of improving sharpness, (3) are not subject to any significant change in performance even after a long-term storage, and (4) which contribute to an improvement in light fastness of dye images formed by color development.

SUMMARY OF THE INVENTION

An object of the invention is to provide a novel color stain inhibitor.

Another object of the invention is to provide a novel color stain inhibitor which is able to efficiently remove the oxidized products of color developing agents or charge-transfer type black developing agents.

Another object of the invention is to provide a novel color stain inhibitor which can be used in light-sensitive materials of reduced thickness.

Another object of the invention is to provide a novel color stain inhibitor which is free from variations in performance even after stored for long periods of time.

Still another object of the invention is to provide a color photographic light-sensitive material containing a novel color stain inhibitor.

It has been found that the objects of the present invention are attained by using: (1) compounds containing two same or different units selected from the group represented by the general formula (I) or (II) as described hereinafter in the molecule, or (2) polymers having a group represented by the general formula (I) or (II) as a pendant.

The present invention relates to a silver halide color photographic light-sensitive material characterized by containing: (1) a compound containing two units represented by the general formula (I) or (II) in the molecule; or (2) a polymer having a group represented by the general formula (I) or (II) as a pendant.

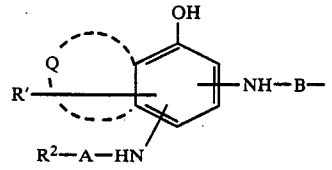

Formula (I)

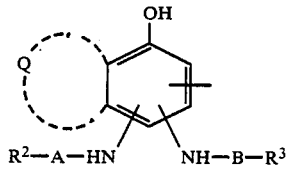

Formula (II)

DETAILED DESCRIPTION OF THE INVENTION

Formulas (I) and (II) will hereinafter be described in detail.

In formulas (I) and (II),

A and B are each —$SO_2$— or —CO—, provided that at least one of A and B is —$SO_2$—, $R^1$ is a hydrogen atom, a halogen atom (e.g., fluorine, chlorine, and bromine), an alkyl group which may be substituted by a halogen atom, for example, and in which the number of carbon atoms is preferably from 1 to 20 (e.g., a methyl group, a tert-butyl group, a cyclohexyl group, and a n-pentadecyl group), an alkoxy group which may be substituted by a halogen atom, for example, and in which the number of carbon atoms is preferably from 1 to 20 (e.g., a methoxy group and a n-butoxy group), an arylsulfonamide group in which the aryl group may further be substituted by an alkyl group, an alkoxy group, etc., and the number of carbon atoms is preferably from 6 to 30 (e.g., a 4-(n-dodcyloxy)benzenesulfonamide group and a p-tolylsulfonamide group), an alkylsulfonamide group in which the alkyl group may be substituted by a halogen atom, a hydroxyl group, etc. and the number of carbon atoms is preferably from 1 to 20 (e.g., a methanesulfonamide group and a n-octanesulfonamide group), an acylamino group which may be further substituted by an alkoxy group, an aryloxy group, an alkyl group, etc. and in which the number of carbon atoms is preferably from 2 to 30 (e.g., an acetylamino group, a benzoylamino group, and an α-(2,4-di-tert-amylphenoxy)propaneamide group), an alkylthio group which may be substituted by a halogen atom, for example, and in which the number of carbon atoms is preferably from 1 to 20 (e.g., a methylthio group and a hexadecylthio group), an arylthio group in which the aryl group may be further substituted by an alkyl group, an alkoxyl group, etc. (e.g., a phenylthio group and a 4-butoxyphenylthio group), a heterocyclic thio group which is preferably 5 or 6-membered, may be substituted by an alkyl group, an aryl group, etc., and in which the total number of carbon atoms is preferably from 1 to 20 (e.g., a 1-phenyltetrazole-5-ylthio group), an alkoxycarbonyl group in which the alkyl group may be substituted by a halogen atom, for example, and the number of carbon atoms is preferably from 2 to 20 (e.g., a methoxycarbonyl group and an ethoxycarbonyl group), an aryloxycarbonyl group in which the aryl group may be further substituted by an alkyl group, an alkoxyl group, etc. and in which the total number of carbon atoms is preferably from 7 to 30 (e.g., a phenoxycarbonyl group), a sulfamoylamino group in which the sulfamoyl group may be further substituted by an alkyl group, an aryl group, etc. and the total number of carbon atoms is preferably from 0 to 20 (e.g., an N,N-dipropylsulfamoylamino group), an alkoxycarbonylamino group in which the number of carbon atoms is preferably from 2 to 20 (e.g., an ethoxycarbonylamino group and a butoxycarbonylamino group), a carbamoylamino group in which the carbamoyl group may be further substituted by an alkyl group, an aryl group, etc. and in which the number of carbon atoms is preferably from 1 to 20 (e.g., an N-phenylcarbamoylamino group), an acyl group in which the number of carbon atoms is preferably from 2 to 20 (e.g., an acetyl group and an ethylcarbonyl group), a sulfonyl group in which the number of carbon atoms is preferably from 1 to 30 (e.g., a benzenesulfonyl group), or a carbamoyl group which may be substituted by an alkyl group, an aryl group, etc. and in which the number of carbon atoms is preferably from 0 to 20 (e.g., an N-phenylcarbamoyl group and an N,N-dioctylcarbamoyl group), $R^2$ and $R^3$ are each an aryl group which may be further substituted by a halogen atom, an alkyl group, an alkoxyl group, etc. and in which the total number of carbon atoms is preferably from 6 to 30 (e.g., a 4-(n-dodecyloxy)phenyl group, a p-tolyl group, a 3,4-dichlorophenyl group, and a 4-dodecylphenyl group), an alkyl group which may be substituted by a halogen atom, a hydroxyl group, an aryloxy group, an alkoxy group, etc. and in which the total number of carbon atoms is preferably from 1 to 30 (e.g., a methyl group, a trifluoromethyl group, a n-hexadecyl group, and a 1-(m-pentadecylphenoxy)propyl group), or an amino group which may be substituted by an alkyl group, an aryl group, etc. and in which the total number of carbon atoms is preferably from 0 to 30 (e.g., a dimethylamino group and a dipropylamino group), preferably substituted or unsubstituted aryl group, and $R^2$ and $R^3$ may be the same or different, and the ring in which the OH group is substituted may form a naphthol ring in combination with an atomic group Q (Q represents an atomic group to be necessary to form a naphthol ring in combination with a phenol ring of the general formula).

Of the compounds containing two units represented by the general formula (I) or (II) in the molecule, those compounds which are represented by the general formula (III) or (IV) are preferred.

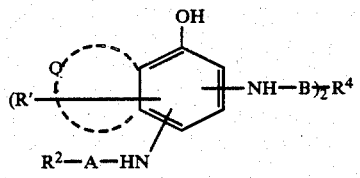

Formula (III)

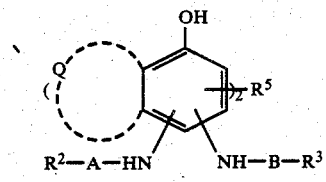

Formula (IV)

In general formulas (III) and (IV),

A, B, $R^1$, $R^2$, $R^3$ and Q are the same as defined for the general formulas (I) and (II), $R^4$ and $R^5$ are each a divalent group connecting two phenol rings or naphthol rings to each other: $R^4$ combines together with B to form a disulfonyl radical preferably having from 3 to 30 carbon atoms (e.g., a 1,3-benzenedisulfonyl group, a 1,5-pentanedisulfonyl group, and a 4',4''-(1,4-diphenoxybutane)disulfonyl group), a diacyl radical preferably having from 2 to 20 carbon atoms (e.g., an oxalyl group, a malonyl group, a sebacoyl group, a phthaloyl group, and a terephthaloyl group), a disulfamoyl group preferably having from 1 to 30 carbon atoms (e.g., —$SO_2NH(CH_2)_4NHSO_2$—), or a dicarbamoyl radical preferably having from 1 to 30 carbon atoms (e.g.,

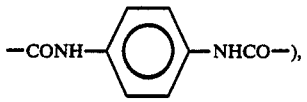

preferably one which forms a disulfonyl radical together with B, and $R^5$ is a substituted or unsubstituted alkylene group preferably having from 1 to 20 carbon atoms (e.g., an ethylmethylene group), a dioxyl radical preferably having from 1 to 20 carbon atoms (e.g., a 1,4-butanedioxyl group), a dithio radical preferably having from 1 to 20 carbon atoms (e.g., a 1,4-butanedithio group), a dioxycarbonyl radical preferably having from 3 to 20 carbon atoms (e.g., —CO—O—$CH_2)_4$—O—CO—), or a dicarbamoyl radical preferably having from 3 to 20 carbon atoms (e.g., —CONH—$CH_2)_4$—NHCO—), the ring in which the OH group is substituted may form a naphthol ring in combination with the atomic group Q, and the substituent of the phenol or naphthol ring may be positioned at any point of the ring.

The compounds of the general formulas (III) and (IV) have two sulfonamidophenol or naphthol skeltons in the molecule and thus have a high reducing ability, preventing color stain even if used in small amounts. For this reason, they are suitable for use in color photographic light-sensitive materials reduced in thickness.

Of the compounds of general formulas (III) and (IV), those compounds having a phenol ring are more effective. Especially preferred are the compounds represented by the following general formulas:

(III)-1

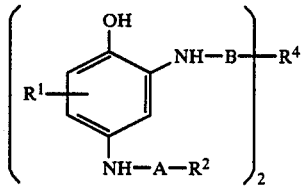

(III)-2

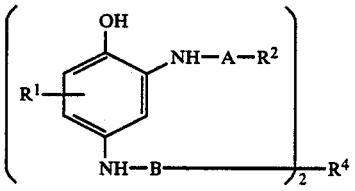

(III)-3

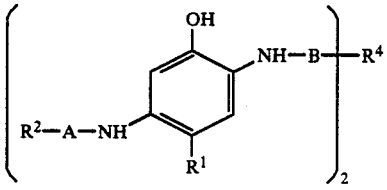

-continued (III)-4

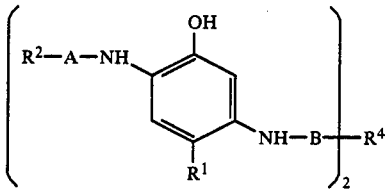

(III)-5

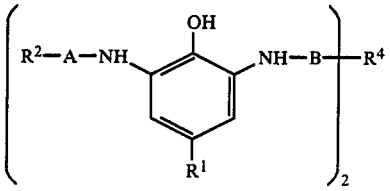

(IV)-1

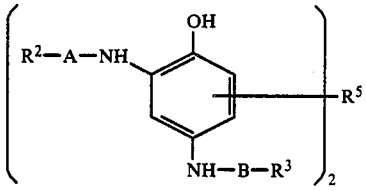

(IV)-2

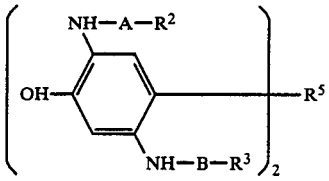

(IV)-3

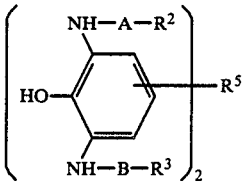

In the general formulas (III)-1 to (III)-5 and (IV)-1 to (IV)-3, A, B, and $R^1$ to $R^5$ are the same as defined for general formulas (III) and (IV).

In general formulas (III)-1, (III)-2, and (IV)-1, $R^1$ is preferably a hydrogen atom, a halogen atom, an alkyl group, an alkoxyl group, an alkylthio group, an alkoxycarbonyl group, an aryloxycarbonyl group, an acyl group, a sulfonyl group, or a carbamoyl group.

In general formulas (III)-3, (III)-4 and (III)-5, $R^1$ is preferably a hydrogen atom, an alkyl group, an acylamino group, an alkoxycarbonyl group, an aryloxycarbonyl group, a sulfamoylamino group, a carbamoylamino group, an acyl group, or a carbamoyl group. Especially preferred are those compounds which in the above general formulas where $R^1$ is an alkyl group, an alkoxycarbonyl group, an aryloxycarbonyl group, an acyl group, or a carbamoyl group, since they do not cause the formation of color due to oxidative coupling with color developing agents at the time of color development.

Of the compounds of the general formulas (III)-1 to (III)-5 and (IV)-1 to (IV)-3, the compounds of the general formulas (III)-1, (III)-2, (III)-3 and (III)-4 are preferred. The most preferred are the compounds represented by the general formulas (III)-1 and (III)-2.

In the above-described general formulas, it is especially preferred for both A and b to be —$SO_2$—.

Typical examples of the compounds represented by the general formulas (III) and (IV) are shown below, although the present invention is not limited thereto.

(1)
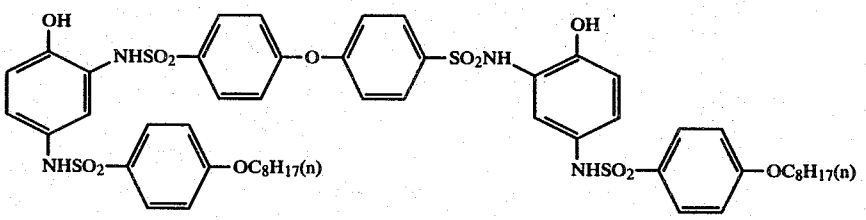
(2)
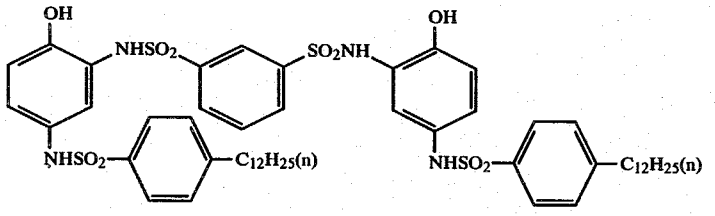
(3)
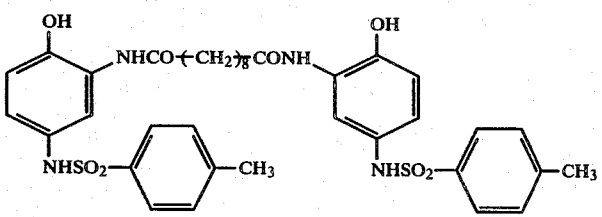
(4)
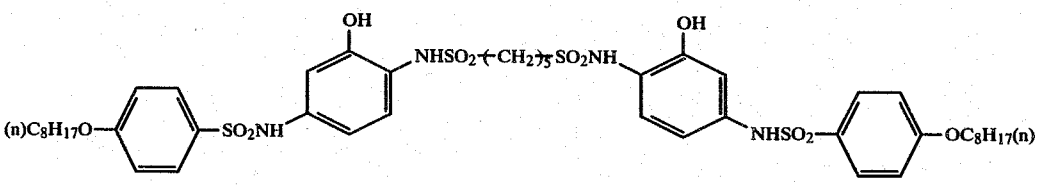
(5)
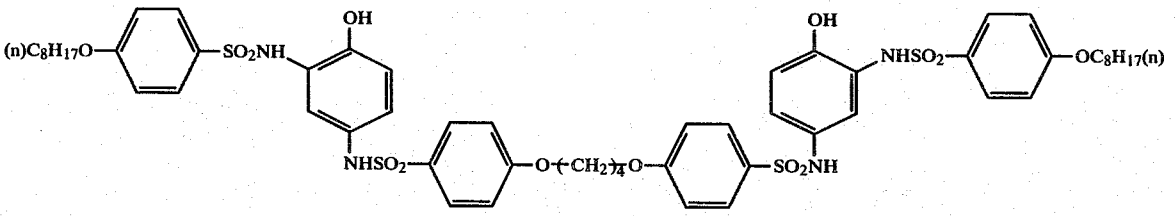
(6)
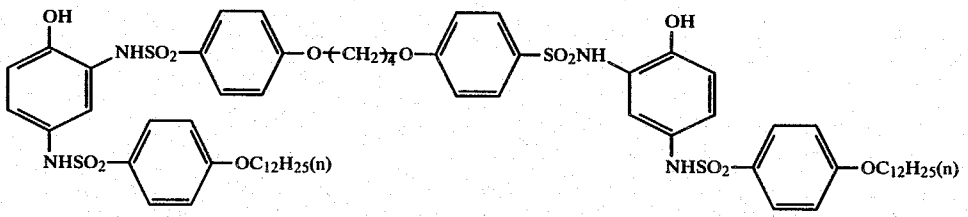

-continued
(7)
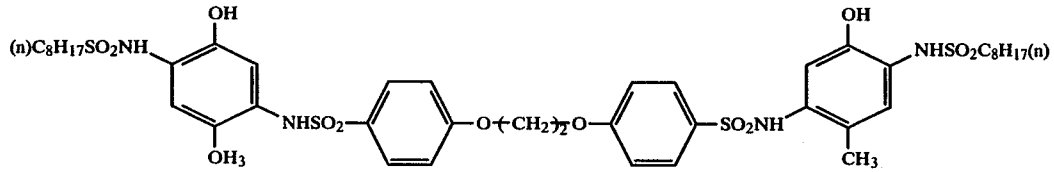
(8)
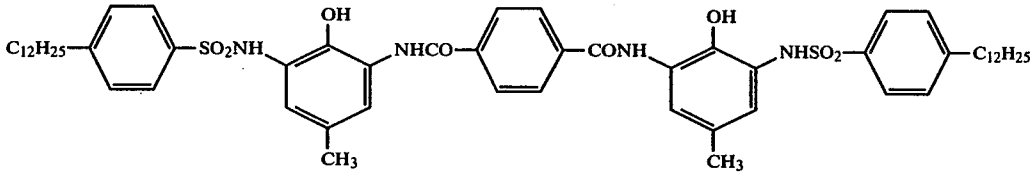
(9)
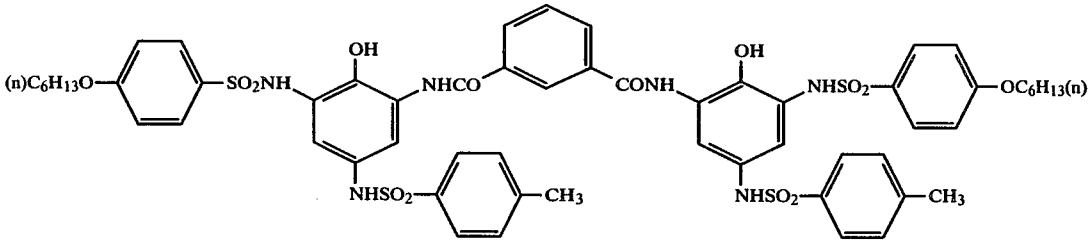
(10)
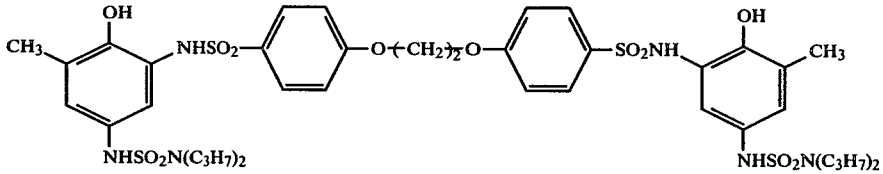
(11)
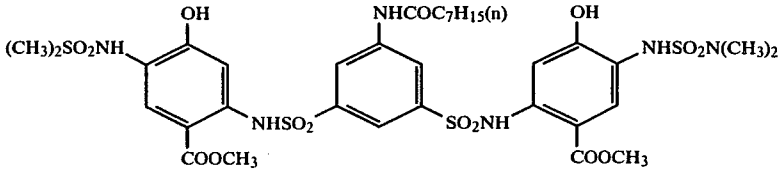
(12)
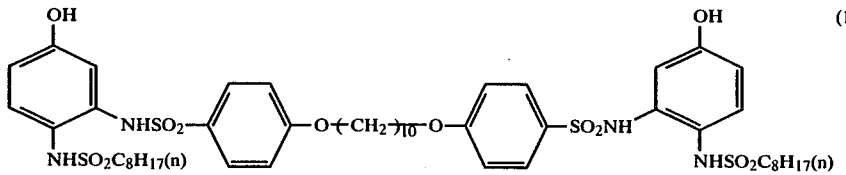

-continued
(13)
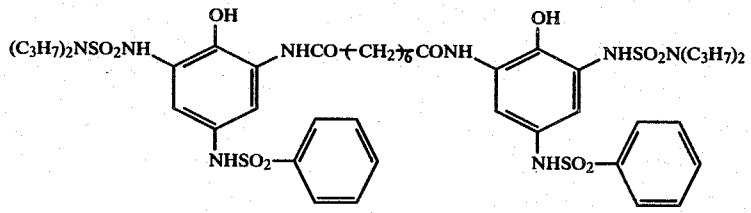
(14)
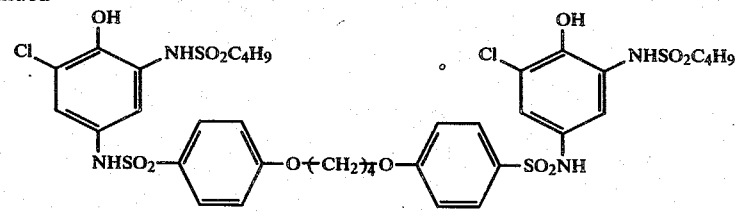
(15)
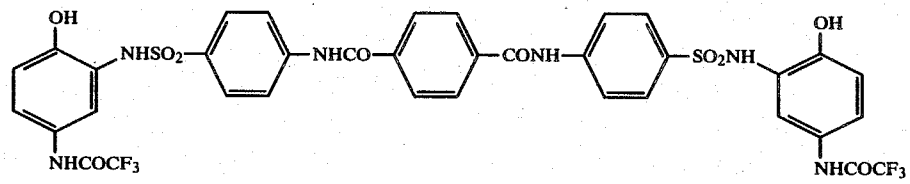
(16)
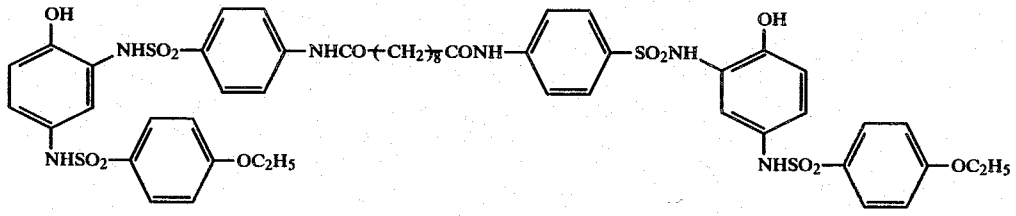
(17)
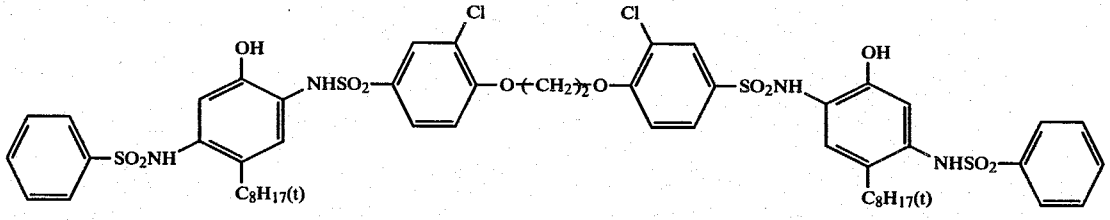
(18)
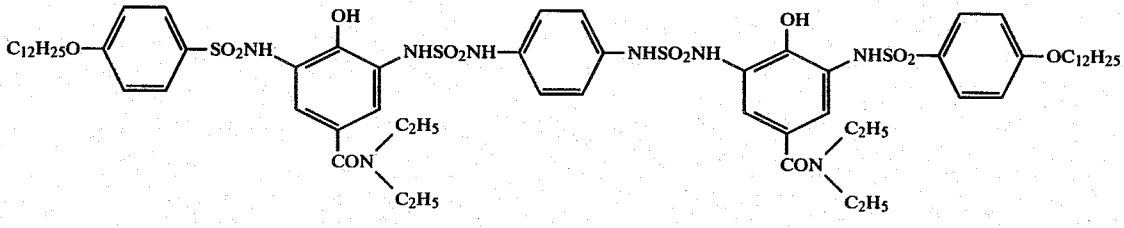

-continued
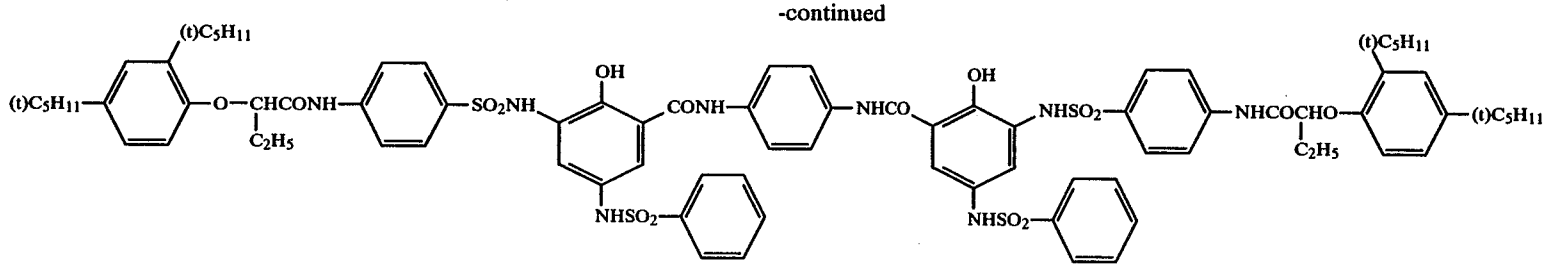
(19)
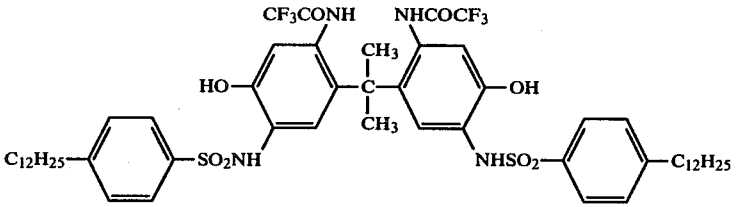
(20)
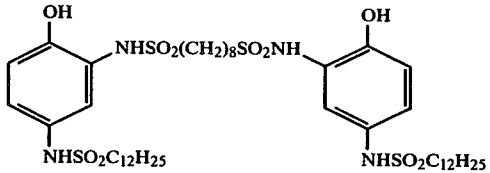
(21)

In general, the compounds of the general formula (I) can be prepared from substituted aminonitrophenol or naphthol compounds by the following two routes:

Route A (A-1)

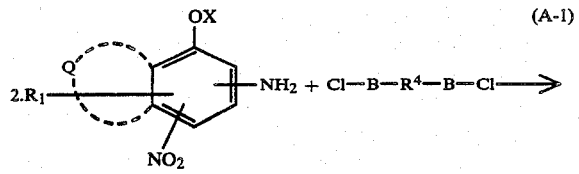

(A-2)

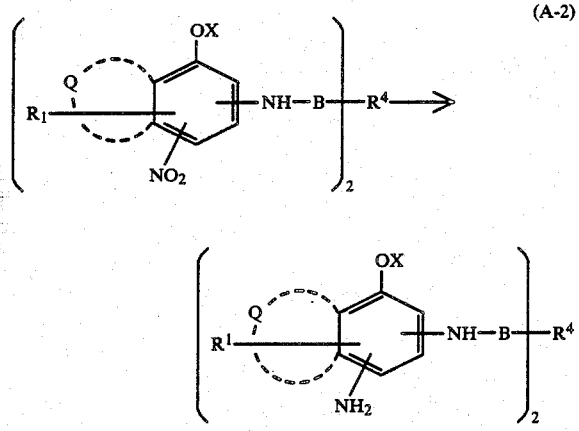

(A-3)

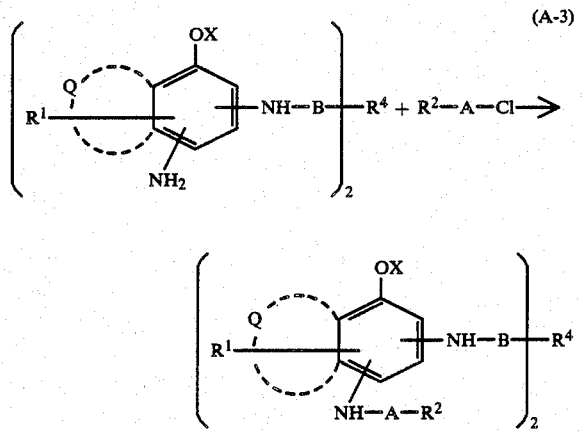

Route B (B-1)

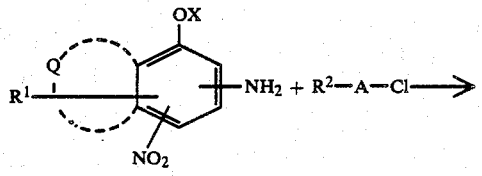

-continued (B-2)

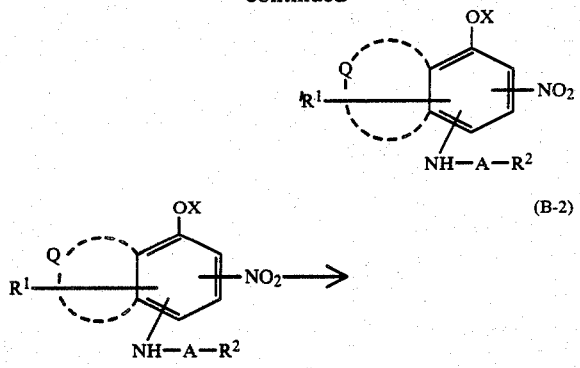

(B-3)

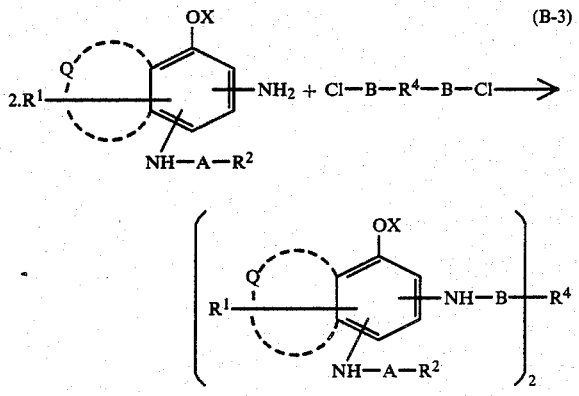

In the above formulas,

A, B, $R^1$, $R^2$, $R^3$, $R^4$ and $R^5$ are as defined in the general formulas (I) and (II), X is a hydrogen atom or a protective group for a hydroxyl group (e.g., a benzyl group), said protective group being capable of being introduced prior to the above-described reactions and removed after the reactions, if necessary, and $R^2$—A—Cl and Cl—B—$R^4$—B—Cl are the acid chlorides of acids containing $R^2$—A— and —B—$R^4$—B— radicals, respectively.

The reactions (A-1), (A-3), (B-1) and (B-3) are directed to amidation of anilines and acid chlorides. In general, this amidation reaction is carried out in a non-protonic polar solvent (e.g., acetonitrile, dimethylformamide, and dimethylacetamide) in the presence of a deacidization agent (e.g., triethylamide, pyridine, 4-(dimethylamino) pyridine, and DBU). However, in the case where X is a hydrogen atom, the de-acidization agent is preferably a reagent of weak basicity (e.g., pyridine) to increase reaction selectivity. The reaction temperature is preferably from 0° C. to the reflux temperature of the solvent used.

The reactions (A-2) and (B-2) are concerned with the reduction of a nitro group into an amino group. In general, this reduction reaction can be carried out by catalytic hydrogenation using hydrogen gas or reduction with metals (e.g., tin and iron).

Synthesis examples of the compounds of the present invention are given below.

SYNTHESIS EXAMPLE 1

Preparation of Compound (6)

Step 1

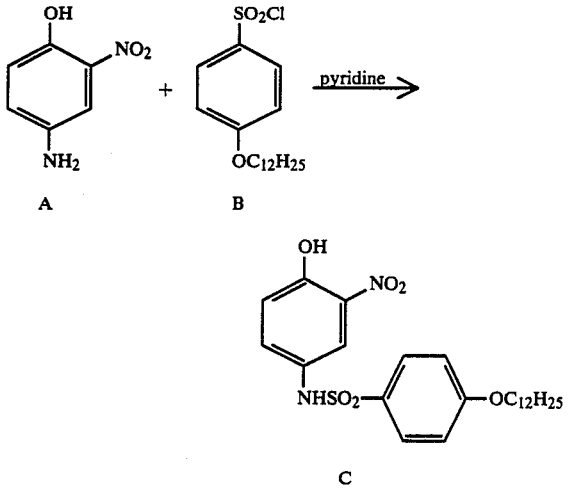

Aniline A (15.4 g) was dissolved in 80 ml of pyridine and stirred, and 36.1 g of solid sulfonyl chloride was added thereto. Some heat generation was observed. The resulting mixture was heated for 1 hour at the reflux temperature and then was allowed to cool for 10 minutes. The mixture was gradually poured into 500 ml of ice water containing 100 ml of concentrated hydrochloric acid while stirring. Crystals precipitated were collected by filtration, washed with water, and dried to yield 47 g of yellow crystals C.

Step 2

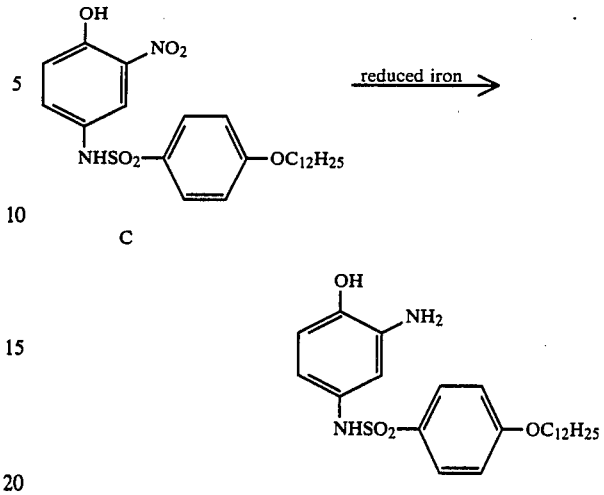

A mixture of 47 g of nitrophenol C and 25 g of reduced iron was added to 200 ml of isopropanol and refluxed by heating with stirring. Ten milliliters of concentrated hydrochloric acid (12N) was gradually added dropwise thereto. The resulting mixture was stirred for 30 minutes and then was allowed to cool. A mixture of 300 ml of ethyl acetate and 300 ml of a 5% aqueous sodium bicarbonate solution was added. Solids were removed by filtration. An ethyl acetate layer was separated, washed with water, and concentrated to yield black brown crude crystals. These crystals were treated with activated carbon and recrystallized from methanol to yield 39 g of light brown crystals D.

Step 3

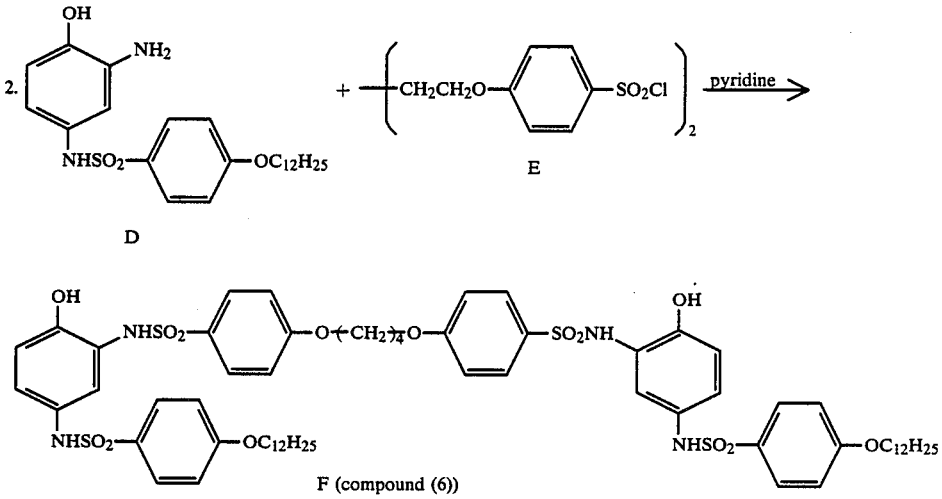

Aminophenol D (22.4 g) was dissolved in 80 ml of pyridine and stirred, and 11.0 g of sulfonyl chloride E was gradually added thereto while cooling with ice. The resulting mixture was heated for 1 hour at the reflux temperature and then was allowed to cool for 10 minutes. Then, 500 ml of ice water containing 100 ml of concentrated hydrochloric acid (12N) was gradually poured into the mixture while stirring. Crystals precipitated were collected by filtration, washed with water, and dried to yield crude crystals. These crystals were treated with activated carbon and then recrystallized from acetonitrile to yield 23 g of white crystals F.

| | Elemental Analysis | | |
|---|---|---|---|
| | C | H | N |
| Calculated for $C_{64}H_{86}N_4O_{14}S_4$ | 60.83 | 6.86 | 4.43 |
| Found | 60.67 | 6.92 | 4.31 |

SYNTHESIS EXAMPLE 2

Preparation of Compound (5)

Step 1

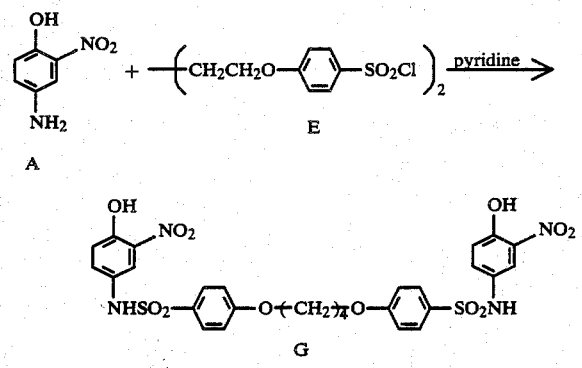

Aniline A (15.4 g) was dissolved in 80 ml of pyridine and stirred, and 22.0 g of sulfonyl chloride E was added thereto. After that, the same procedure as in Step 1 of Synthesis Example 1 was repeated to yield 33 g of yellow crystals G.

Step 2

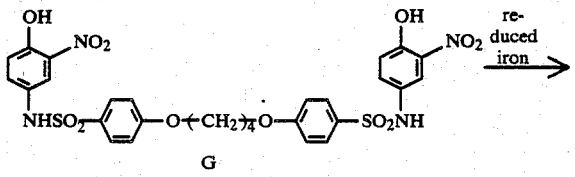

-continued

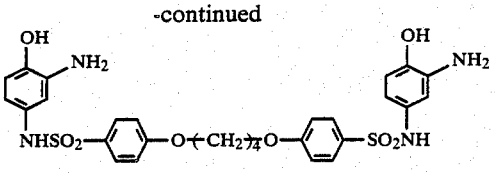

Nitrophenol G (33 g) was reacted in the same manner as in Step 2 of Synthesis Example 1 to yield 25 g of aminophenol H.

Step 3

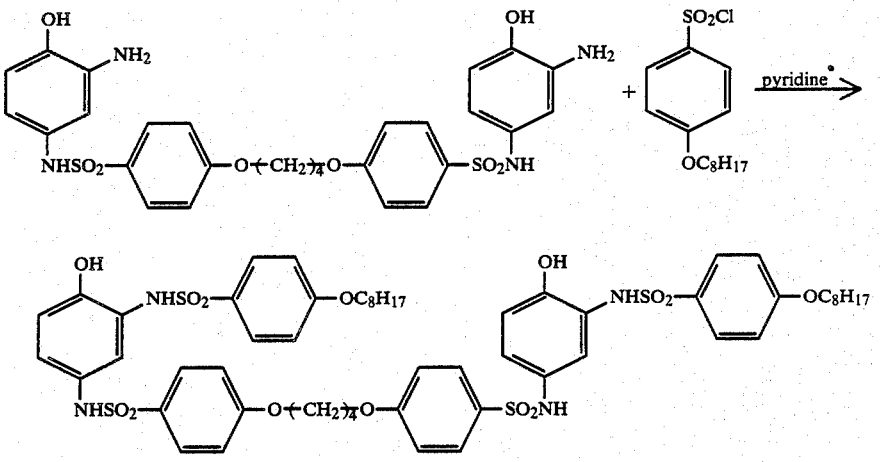

Aminophenol H (15.4 g) was reacted with 15.2 g of sulfonyl chloride in the same manner as in Step 3 of Synthesis Example 1 to yield 22 g of white crystals.

| | Elemental analysis | | |
|---|---|---|---|
| | C | H | N |
| Calculated for $C_{56}H_{70}N_4O_{14}S_4$ | 58.41 | 6.13 | 4.87 |
| Found | 58.17 | 5.98 | 4.76 |

When the compounds of the general formulas (III) and (IV) are used as color turbidity inhibitors in the intermediate layer, it is preferred for them to be added in an amount of from $1.0\times10^{-3}$ to $1.0\times10^{-5}$ mol per square meter of the layer. When they are used as color fog inhibitors in the emulsion layer, it is preferred for them to be added in an amount of from $1.0\times10^{-4}$ to $1.0\times10^{-6}$ mol per square meter of the layer. It is to be noted that the present invention is not limited to the above-described limits. Furthermore, the compounds can also be added to both the intermediate and emulsion layers so that they serve as color turbidity and color fog inhibitors.

In introducing the compounds of the general formulas (III) and (IV) into constituents layers such as an emulsion layer and an intermediate layer, there can be employed known techniques which are used in introducing couplers into the emulsion layer. For example, the compounds are dissolved in phthalic acid alkyl esters (e.g., dibutyl phthalate and dioctyl phthalate), phosphoric acid esters (e.g., diphenyl phosphate, triphenyl phosphate, tricresyl phosphate, and dioctylbutyl phosphate), citric acid esters (e.g., tributyl acetylcitrate), benzoic acid esters (e.g., octyl benzoate), alkylamides (e.g., diethyllaurylamide), fatty acid esters (e.g., dibutoxyethyl succinate and dioctyl azelate), trimesinic acid esters (e.g., tributyl trimesinate), etc., or organic solvents having a boiling point ranging between about 30° and 150° C., such as lower acetates (e.g., ethyl acetate and butyl acetate), ethyl propionate, sec-butyl alcohol, methyl isobutyl ketone, β-ethoxyethyl acetate, and methyl cellosolve acetate, and then dispersed in hydrophilic colloids. The above-described high boiling and low boiling organic solvents may be used in combination with each other.

As polymers containing the group of the general formula (I) or (II) as a pendant, those polymers having a repeating unit represented by the general formula (V) or (VI) are preferred.

Formula (V)

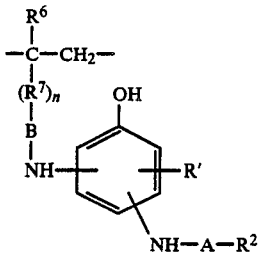

Formula (VI)

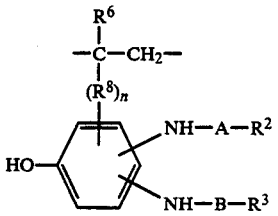

In the general formulas (V) and (VI),

A, B, $R^1$, $R^2$ and $R^3$ are the same as defined for the general formulas (I) and (II), $R^7$ and $R^8$ are divalent connecting groups preferably having from 1 to 20 carbon atoms (e.g.,

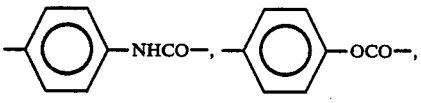

and a p-phenylene group), $R^6$ is a hydrogen atom, a halogen atom (e.g., fluorine, chlorine, and bromine), or an alkyl group preferably having from 1 to 6 carbon atoms (e.g., a methyl group, and an ethyl group), and n is 0 or 1.

The substituent on the phenol ring of the general formulas (V) and (VI) may be positioned at any point of the ring.

The compounds of the general formulas (V) and (VI) have preferably a molecular weight of about 5,000 to 100,000, more preferably 10,000 to 50,000.

Of the compounds of the general formulas (V) and (VI), the compounds of the general formula (V) are preferred.

Of the repeating units represented by the general formula (V), those units represented by the general formulas as described below are preferred.

(V)-1

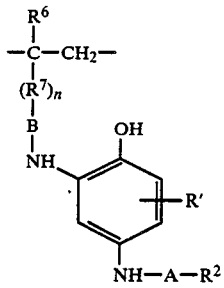

(V)-2

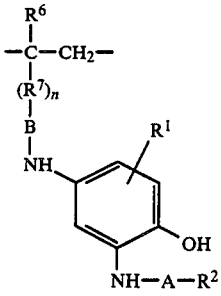

(V)-3

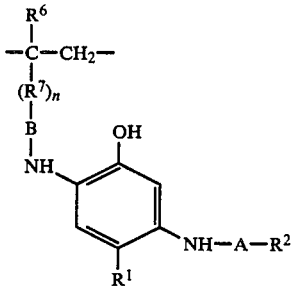

(V)-4

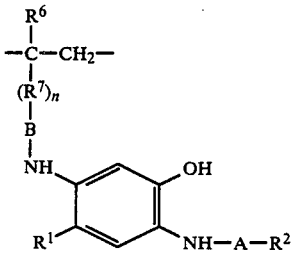

(V)-5

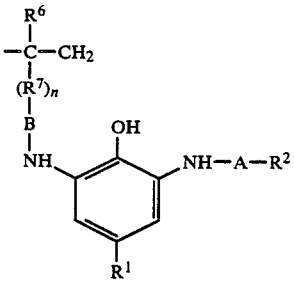

In the general formulas (V)-1 to (V)-5, A, B, $R^1$ to $R^6$, and n are the same as defined for the general formula (V).

In the general formulas (V)-1 and (V)-2, $R^1$ is preferably a hydrogen atom, a halogen atom, an alkyl group, an alkoxyl group, an alkylthio group, an alkoxycarbonyl group, an arylthio group, a heterocyclic thio group, an aryloxycarbonyl group, an acyl group, a sulfonyl group, or a carbamoyl group.

In the general formulas (V)-3 and (V)-4, $R^1$ is preferably a hydrogen atom, a halogen atom, an alkyl group, an acylamino group, an alkoxycarbonyl group, an aryloxycarbonyl group, a sulfonyl group, a sulfamoylamino group, a carbamoylamino group, an acyl group, or a carbamoyl group. Especially preferred are those groups which do not form color by oxidative coupling with color developing agents at the time of color development (e.g., an alkyl group, an alkoxycarbonyl group, a sulfonyl group, an aryloxycarbonyl group, an acyl group, and a carbamoyl group).

Of the repeating units of the general formulas (V)-1 to (V)-5, the units of the general formulas (V)-1 to (V)-4 are preferred.

In the general formulas (V), (V)-1 to (V)-5, and (VI), $R^2$ and $R^3$ are especially preferred to be an aryl group or an alkyl group.

In the general formulas (V), (V)-1 to (V)-5, and (VI), it is preferred for both of A and B to be $—SO_2—$.

Of the compounds of the general formulas (V), (V)-1 to (V)-5, and (VI), the compounds represented by the general formula (V)-1 or (V)-2 are most preferred.

The polymers of the present invention may be homopolymers composed of only the repeating unit represented by the general formula (V) or (VI), or copolymers composed of the repeating units represented by the general formulas (V) and (VI). In addition, they may be copolymers containing the repeating unit of the general formula (V) and/or the repeating unit of the general formula (VI) and one or more repeating units other than those of the general formulas (V) and (VI). These polymers, homopolymers or copolymers, can be prepared by homopolymerization of monomers from which the repeating unit of the general formula (V) or (VI) can be derived, copolymerization of monomers from which the repeating units of the general formulas (V) and (VI) can be derived, or copolymerization of the monomers and ethylenically unsaturated monomers capable of undergoing addition polymerization therewith.

Typical examples of monomers from which the repeating unit of the general formula (V) or (VI) can be derived are shown below, although the present invention is not limited thereto.

m-(1)

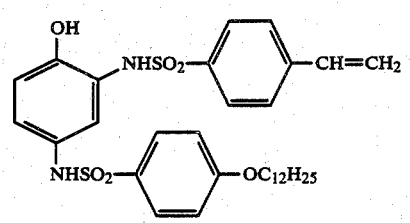

m-(2)

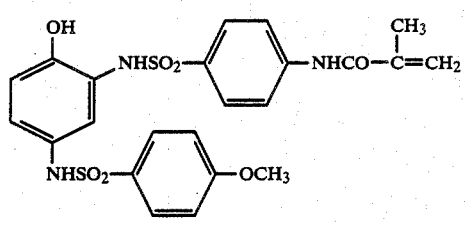

m-(3)

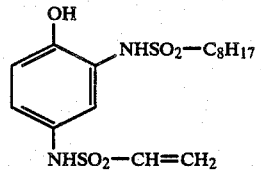

m-(4)

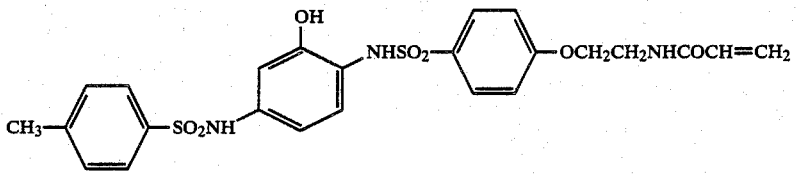

m-(5)

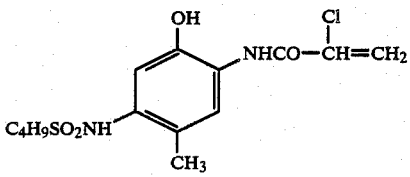

m-(6)

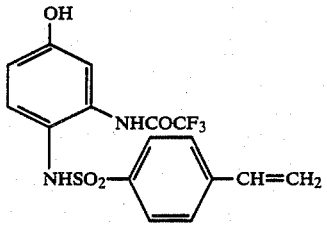

m-(7)

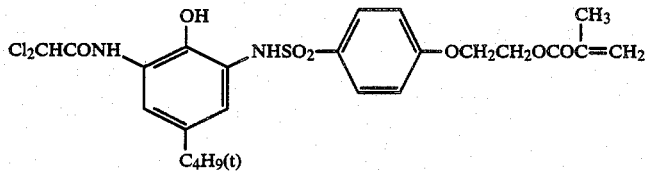

-continued
m-(8)
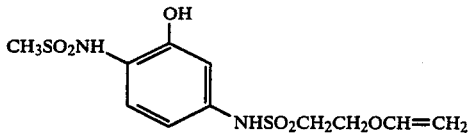
m-(9)
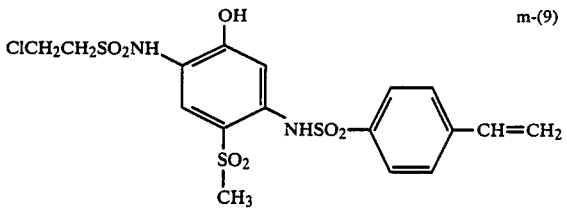
m-(10)
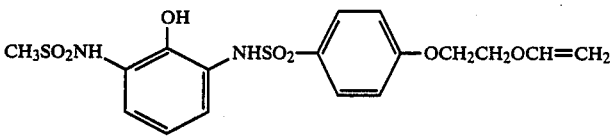
m-(11)
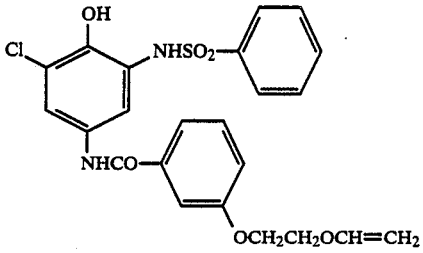
m-(12)
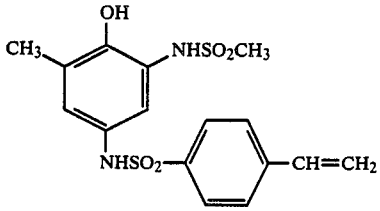
m-(13)
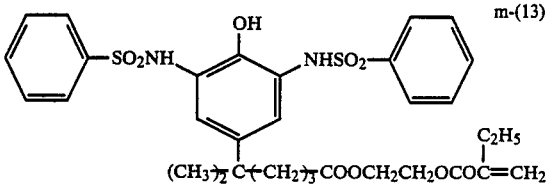
m-(14)
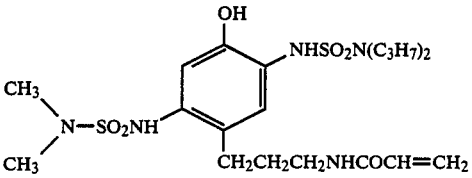
m-(15)
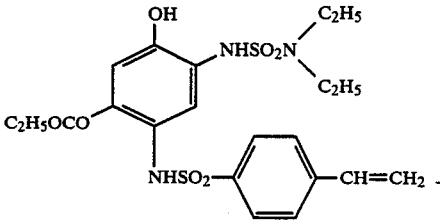
m-(16)
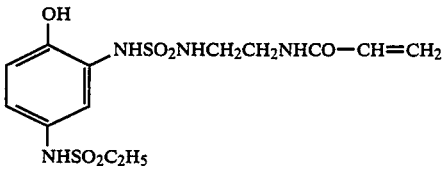
m-(17)
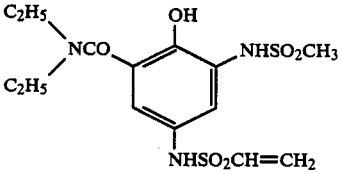
m-(18)
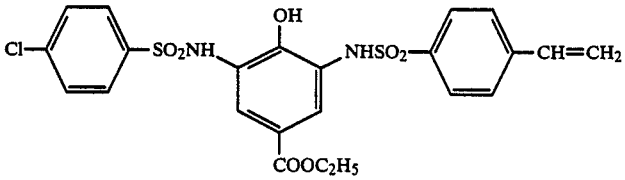

-continued m-(19)

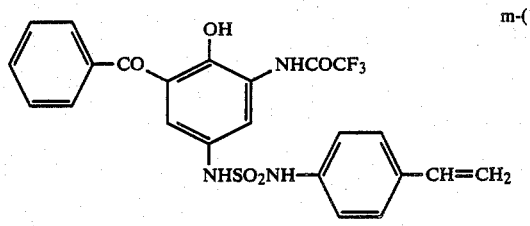

m-(20)

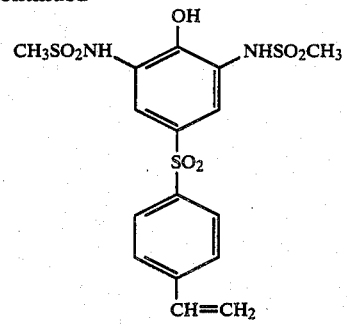

m-(21)

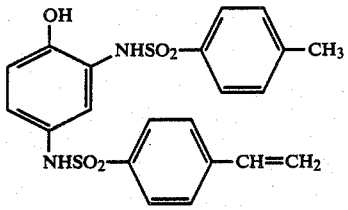

m-(22)

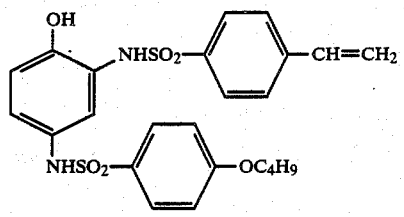

As ethylenically unsaturated monomers addition-copolymerizable with the monomers from which the repeating unit of general formula (V) or (VI) can be derived, there can be used in principle all water-insoluble monomers which are liquid at the polymerization temperature (usually from 50° to 95° C. and preferably from 70° to 90° C.). Typical examples of these ethylenically unsaturated monomers include esters or amides derived from acrylic acids such as acrylic acid, α-chloroacrylic acid, α-aracrylic acid (e.g., methacrylic acid), etc., (e.g., tert-butylacrylamide, methyl acrylate, methyl methacrylate, ethyl acrylate, n-propyl acrylate, n-butyl acrylate, n-butyl methacrylate, 2-ethylhexyl acrylate, n-hexyl acrylate, and octyl methacrylate), vinyl esters (e.g., vinyl acetate and acrylonitrile), aromatic vinyl compounds (e.g., styrene, vinyltoluene, and divinylbenzene), and vinyl alkyl ethers (e.g., vinyl ethyl ether and maleic acid esters). The preferred copolymerization ratio of the monomers, from which the repeating unit of the general formula (V) or (VI) can be derived, and the ethylenically unsaturated monomers capable of undergoing addition polymerization therewith is about 0.2 to 0.9. The preferred examples of such ethylenically unsaturated monomers include an alkyl ester of acrylic acid or methacrylic acid, more preferably an alkyl ester having 4 carbon atoms or less.

The compositions of the homopolymers or copolymers of the present invention are shown below, although the present invention is not limited thereto.

(a)

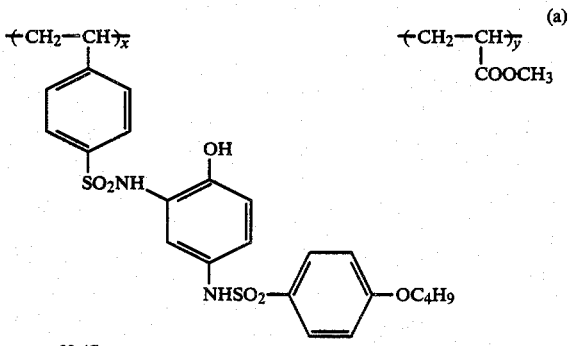

x:y = 53:47

-continued (b)

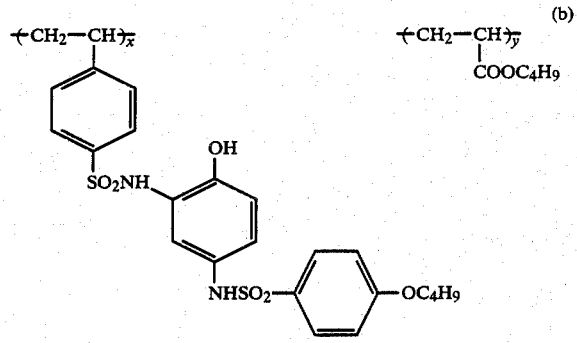

x:y = 41:59

(c)

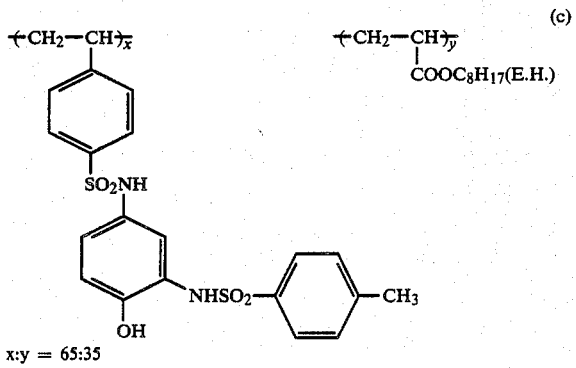

x:y = 65:35

-continued (d)

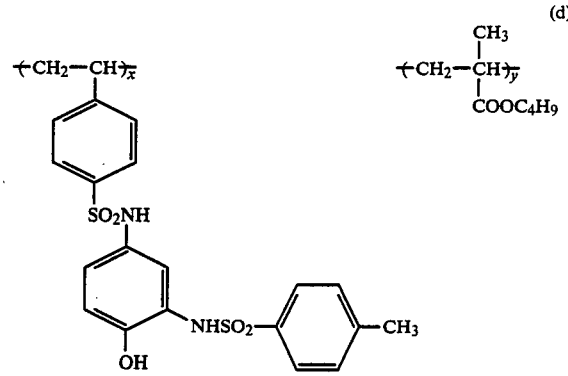

x:y = 32:68

The monomers from which the repeating units of the general formulas (V) and (VI) can be derived can be prepared from sulfonamide-substituted aminophenols and ethylenically unsaturated monomers containing an acid halide radical by the amidation reaction.

A synthesis example of a monomer as used herein is given below

SYNTHESIS EXAMPLE 1

Preparation of Compound m-(1)

Step 1

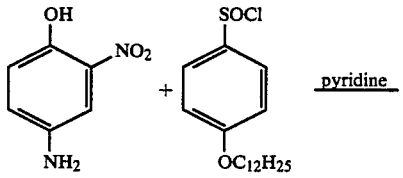

A B

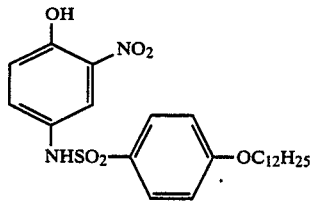

C

Aniline A (15.4 g) was dissolved in 80 ml of pyridine and stirred, and 36.1 g of solid sulfonyl chloride B was added thereto. Some heat generation was observed. The resulting mixture was heated for 1 hour at the reflux temperature and then was allowed to cool for 10 minutes. Then, the mixture was gradually poured on to 500 ml of ice water containing 100 ml of concentrated hydrochloric acid (12N) while stirring. Crystals precipitated were collected by filtration, washed with water, and then dried to yield 47 g of yellow crystals C.

Step 2

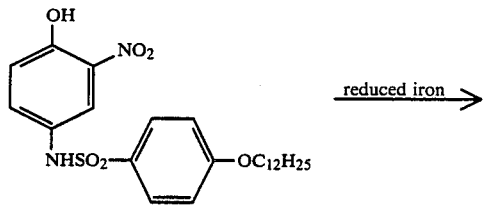

C

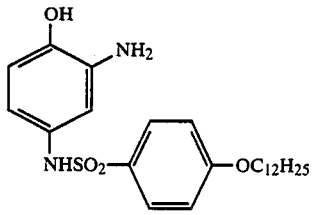

D

A mixture of 47 g of nitrophenol C and 25 g of reduced iron was placed in 200 ml of isopropanol and refluxed by heating while stirring. Ten milliliters of concentrated hydrochloric acid (12N) was gradually added dropwise thereto. The resulting mixture was stirred for 30 minutes and then was allowed to cool, and 300 ml of ethyl acetate and 300 ml of a 5% aqueous sodium bicarbonate solution were added thereto. Solids formed were removed by filtration. The ethyl acetate layer was separated, washed with water, and then concentrated to yield black brown crude crystals. These crystals were treated with activated carbon and recrystallized from methanol to yield 39 g of light brown crystals D.

Step 3

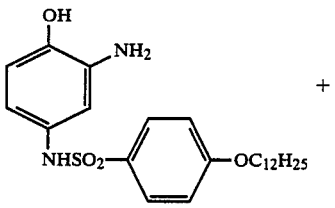

D

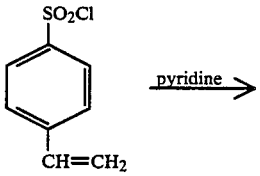

E

-continued

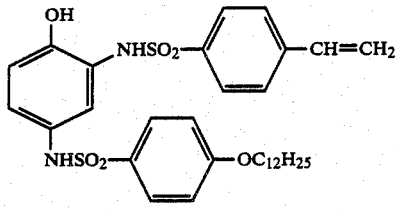

F (Compound m-(1))

A mixture of 22.4 g of aniline D and 1 ml of nitrobenzene was dissolved in 80 ml of pyridine and stirred, and 10.1 g of sulfonyl chloride E was added thereto. The resulting mixture was heated at 60° C. for 1 hour and then was allowed to cool for 10 minutes. This mixture was gradually poured into 500 ml of ice water containing 100 ml of concentrated hydrochloric acid (12N) while stirring. Crystals precipitated were collected by filtration, washed with water, dried and then purified to yield 19 g of light brown crystals F.

| | Elemental Analysis | | |
|---|---|---|---|
| | C | H | N |
| Calculated for $C_{32}H_{42}N_2O_6Os$ | 62.51 | 6.88 | 4.56 |
| Found | 62.30 | 6.69 | 4.48 |

A synthesis example of a polymer as used herein is given below.

SYNTHESIS EXAMPLE 2

Preparation of Polymer (b)

A mixture of 30 g of Compound m-(22) and 10 g of butyl acrylate was dissolved in 200 ml of dioxane. The resulting solution was heated to 70° C. and then 0.4 g of methyl azobisisobutyrate was added thereto. The mixture was stirred for 1 hour and then 0.4 g of methyl azobisisobutyrate was added. The resulting mixture was heated to 100° C. and stirred for 1 hour at that temperature. After being allowed to cool, the mixture was added dropwise to 2 liters of ice water, and then filtered. The residue was dried to yield 37 g of white polymer.

When the homopolymer or copolymer containing the repeating unit of the general formula (V) or (VI) is used as a color turbidity inhibitor in an intermediate layer, it is preferred for the equivalent of the sulfonamidophenol radical contained in the repeating unit of the general formula (I) or (II) to be from $1.0\times10^{-3}$ to $1.0\times10^{-5}$ mol per square meter of the layer. On the other hand, when the homopolymer or copolymer is used as a color fog inhibitor in an emulsion layer, it is preferably added in an amount of from $1.0\times10^{-4}$ to $1.0\times10^{-6}$ mol per square meter of the layer. It is to be noted that the present invention is not limited to the above-described limits. Furthermore, the homopolymer or copolymer can be added to both the intermediate and emulsion layers so as to function as both the color turbidity and color fog inhibitors.

The homopolymer or copolymer of the present invention can contain a high concentration of sulfonamidophenol radical and causes only a limited increase in viscosity of an aqueous gelatin solution. For this reason, it is suitable for use in light-sensitive materials reduced in thickness.

The homopolymer or copolymer of the present invention is preferably added to a coating liquid (in many cases, an aqueous gelatin solution) in the form of dispersions in water, i.e., so-called polymer latexes and then is coated.

The color stain inhibitor of the present invention is markedly effective in preventing color stain of silver halide color photographic light-sensitive materials of the type that forms a color image by oxidative coupling of aromatic primary amine developing agents (e.g., phenylenediamine derivatives and aminophenol derivatives) with color-forming couplers at the color development processing, such as a color paper, a color negative film, a color reversal film, etc.

Various color-forming couplers can be used in the preparation of color photographic light-sensitive material, of the above-described type. For example, as magenta couplers, a 5-pyrazolone coupler, a pyrazolobenzimidazole coupler, a cyanoacetylcumarone coupler, a closed-chain acylacetonitrile coupler, etc. can be used; as yellow couplers, an acylacetoamide coupler (e.g., benzoylacetoanilides and pivaloylacetoanilides), etc. can be used; and as cyan couplers, a naphthol coupler, a phenol coupler, etc. can be used.

These couplers can be made non-diffusing by introducing a hydrophobic group called a ballast group into the molecule or linking the hydrophobic group to a polymer chain, and are preferably used in such non-diffusion form.

The couplers may be four-equivalent or two-equivalent relative to silver ion. In addition, colored couplers having the effect of color correction, or DIR couplers releasing a development inhibitor with the progress of development can be used.

Typical examples of magenta couplers are described in, for example, U.S. Pat. Nos. 2,600,788, 2,983,608, 3,062,653, 3,127,269, 3,311,476, 3,419,391, 3,519,429, 3,558,319, 3,582,322, 3,615,506, 3,834,908, 3,891,445, West German Pat. No. 1,810,464, West German Patent Application (OLS) Nos. 2,408,665, 2,417,945, 2,418,959, 2,424,467, Japanese Patent Publication No. 6031/65, Japanese Patent Application (OPI) Nos. 20826/76, 58922/77, 129538/74, 74027/74, 159336/75, 42121/77, 74028/74, 60233/75, 26541/76, and 55122/78.

Typical examples of yellow couplers are described in, for example, U.S. Pat. Nos. 2,875,057, 3,265,506, 3,408,194, 3,551,155, 3,582,322, 3,725,072, 3,891,445, West German Pat. No. 1,547,868, West German Patent Laid-Open Nos. 2,219,917, 2,261,361, 2,414,006, British Patent 1,425,020, Japanese Patent Publication No. 10783/76, Japanese Patent Application (OPI) Nos. 26133/72, 73147/73, 102636/76, 6341/75, 123342/75, 130442/75, 21827/76, 87650/75, 82424/77, and 115219/77.

Typical examples of cyan couplers are described in, for example, U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411, 4,004,929, West Patent Application (OLS) Nos. 2,414,830, 2,454,329, Japanese Patent Application (OPI) Nos. 59838/73, 26034/76, 5055/73, 146828/76, 69624/77, and 90932/77.

As colored couplers, compounds as described in U.S. Pat. Nos. 3,476,560, 2,521,908, 3,034,892, Japanese Patent Publication Nos. 2016/69, 22335/63, 11304/67, 32461/69, Japanese Patent Application (OPI) Nos.

26034/76, 42121/77, and West German Patent Application (OLS) No. 2,418,959 can be used.

As DIR couplers, compounds as described in U.S. Pat. Nos. 3,227,554, 3,617,291, 3,701,783, 3,790,384, 3,632,345, West German Patent Application (OLS) Nos. 2,414,006, 2,454,301, 2,454,329, British Patent 953,454, Japanese Patent Application (OPI) Nos. 69624/77, 122335/74, and 16141/76 can be used.

The color stain inhibitors of the present invention are also effective in preventing color stain of silver halide color photographic light-sensitive materials of the so-called diffusion transfer type. Dye image-forming compounds for use in light-sensitive materials of the type as described above include dye developing agents, dye-releasing redox compounds, and DDR couplers. Specifically, compounds as described in U.S. Pat. Nos. 4,053,312, 4,055,428, 4,076,529, 4,152,153, 4,135,929, Japanese Patent Application (OPI) Nos. 149328/78, 104343/76, 46730/78, 130122/79, 3819/78, Japanese Patent Application Nos. 89128/79, 90806/79, and 91187/79 can be used.

The color stain inhibitors of the present invention can be used in combination with known color stain inhibitors such as hydroquinone derivatives, aminophenol derivatives, gallic acid derivatives, and ascorbic acid derivatives. Typical examples of such known inhibitors are described in U.S. Pat. Nos. 2,360,290, 2,336,327, 2,403,721, 2,418,613, 2,675,314, 2,701,197, 2,704,713, 2,728,659, 2,732,300, 2,735,365, Japanese Patent Application (OPI) Nos. 92988/75, 92989/75, 93928/75, 110337/75, 146235/77, and Japanese Patent Publication No. 23813/75.

The light-sensitive material of the present invention may contain ultraviolet absorbers in the hydrophilic colloid layer thereof. Ultraviolet absorbers which can be used include aryl group-substituted benzotriazole compounds, 4-thiazolidone compounds, benzophenone compounds, cinnamic acid ester compounds, butadiene compounds, and benzooxazole compounds. In addition, ultraviolet ray-absorbing polymers can be used. These ultraviolet absorbers may be fixed in the above-described hydrophilic colloid layer.

With regard to photographic silver halide emulsions and their methods of preparation, photographic additives (or photographic materials), and so forth which can be used in the color light-sensitive material of the present invention, reference can be made to *Research Disclosure*, No. 176 (November 1978), pages 22–31, "Preparation and Type of Emulsions", "Rinsing of Emulsions", "Chemical Sensitization", "Antifoggants and Stabilizers", "Hardening Agents", "Supports", "Plasticizers and Lubricants", "Coating Assistants", "Matting Agents", "Sensitizers", "Spectral Sensitizers", "Method of Addition", "Absorption and Filter Dyes", and "Coating Methods".

Color image formation can be achieved by various techniques such as the negative-positive process (described in, for example, *Journal of the Society of Motion Picture and Television Engineers*, vol. 61 (1953), pages 667–701), the color reversion process in which a negative silver image is first formed by developing with a developer solution containing a black and white developing agent and then is subjected to at least one uniform light-exposure or other suitable fog treatment, and subsequently color development is applied to form a dye positive image, and the silver dye bleach process in which a photographic emulsion layer containing a dye is exposed to light and then developed to form a silver image, and with the thus-formed silver image as a bleach catalyst, the dye is bleached.

A color developer is generally an alkaline aqueous solution containing color developing agents. As these color developing agents, known primary aromatic amine developing agents can be used, including phenylenediamines such as 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, and 4-amino-3-methyl-N-ethyl-N-β-methoxyethylaniline.

In addition, the compounds described in L. F. A. Mason, *Photographic Processing Chemistry*, Focal Press Co., (1966), pages 226–229, U.S. Pat. Nos. 2,193,015, 2,592,364, and Japanese Patent Application (OPI) No. 64933/73 can be used.

The color developer can further contain pH buffers (e.g., sulfites, carbonates, borates and phosphates of alkali metals), development inhibitors or antifoggants (e.g., bromides, iodides and organic antifoggants), and so forth. If necessary, it may contain hard water-softening agents, preservatives (e.g., hydroxylamines), organic solvents (e.g., benzyl alcohol and diethylene glycol), development accelerators (e.g., polyethylene glycol, quaternary ammonium salts, and amines), dye-forming couplers, competitive couplers, foggants (sodium borohydride), auxiliary developing agents (e.g., 1-phenyl-3-pyrazolidone), tackifiers, polycarboxylic acid-based chelating agents as described in U.S. Pat. No. 4,083,723, antioxidants as described in West German Patent Laid-Open (OLS) No. 2,622,950, and so forth.

After color development, photographic emulsion layers are usually bleached. This bleach processing may be performed simultaneously with a fix processing, or they may be performed separately. Bleaching agents which can be used include polyvalent metal (e.g., iron (III), cobalt (III), chromium (VI), and copper (II)) compounds, peracids, quinones, and nitroso compounds. For example, ferricyanide compounds, dichromates, organic complex salts of iron (III) or cobalt (III), such as complex salts of aminopolycarboxylic acids (e.g., ethylenediaminetetraacetic acid, nitrilotriacetic acid, and 1,3-diamino-2-propanoltetraacetic acid) or organic acids (e.g., citric acid, tartaric acid, and lactic acid), persulfates, permanganates, and nitrosophenol can be used. Of these compounds, potassium ferricyanide, sodium iron (III) ethylenediaminetetraacetate, and ammonium iron (III) ethylenediaminetetraacetate are particularly useful. Ethylenediaminetetraacetic acid iron (III) complex salts are useful in both an independent bleaching solution and a combined bleach-fixing solution.

To this bleaching or bleach-fixing solution can be added various additives such as bleach accelerators as described in U.S. Pat. Nos. 3,042,520, 3,241,966, Japanese Patent Publication Nos. 8506/70, and 8836/70, and thiol compounds as described in Japanese Patent Application (OPI) No. 65732/78.

When the light-sensitive material of the present invention is processed by the diffusion transfer process, a viscous developer can be used in the processing. This viscous developer is a liquid composition containing ingredients necessary for development of silver halide emulsions and formation of diffusion transfer dye images. The solvent used is composed mainly of water and sometimes contains hydrophilic solvents such as methanol and methyl cellosolve. The processing composition contains sufficient amounts of alkalis to maintain the necessary pH for causing development of emulsion layers and to neutralize acids (e.g., hydrohalogenic acids such as hydrobromic acid and carboxylic acids such as acetic acid) which are formed during the steps of development and dye image formation. These alkalis include alkali metal or alkaline earth metal salts, such as lithium hydroxide, sodium hydroxide, potassium hydroxide, a calcium hydroxide dispersion, hydroxytetramethylammonium, sodium carbonate, trisodium phosphate, and amines such as diethylamine. Preferably caustic alkali is added in a concentration such that the pH at room temperature is about 12 or more, particularly about 14 or more. It is more preferred for the processing composition to contain hydrophilic polymers such as high molecular weight polyvinyl alcohol, hydroxyethyl cellulose, and sodium carboxymethyl cellulose. These polymers are preferably added in an amount such that the viscosity at room temperature of the resulting processing composition is at least 1 poise, particularly from several hundred (500–600) to 1,000 poises.

The present invention is described in greater detail with reference to the following examples.

EXAMPLE 1

Preparation of Film A

A blue-sensitive silver chlorobromide emulsion containing a yellow coupler, α-pivaloyl-α(2,4-dioxo-5,5'-dimethyloxazolidine-3-yl)-2-chloro-5-[α-(2,4-di-tert-pentylphenoxy)butaneamido]acetanilide (silver bromide: 70 mol%; silver chloride: 30 mol%) was coated on a polyethylene double-coated baryta paper support in a thickness of 3.0μ to form an emulsion layer (First Layer) (amount of the coupler coated: $0.646\times10^{-3}$ mol/m$^2$; amount of the silver coated: $3.88\times10^{-3}$ mol/m$^2$).

A gelatin layer (Second Layer) was coated on the first layer in a thickness of 1.5μ.

A gelatin layer containing a magenta coupler, 1-(2,4,6-trichlorophenyl)-3-{2-chloro-(5-tetradecaneamido)anilino}-5-pyrazolone was coated on the second layer in a thickness of 3.1μ (Third Layer) (amount of the coupler coated: $0.500\times10^{-3}$ mol/m$^2$).

Preparation of Film B

This film was prepared in the same manner as in Film A except that the second layer contained 2,5-di-tertoctylhydroquinone (amount of hydroquinone coated: $1.59\times10^{-4}$ mol/m$^2$).

In addition, the following materials, Films C to F, were prepared.

Film C

This film was the same as Film A except that the second layer contained Compound (5) of the present invention (amount of Compound (5) coated: $8.0\times10^{-5}$ mol/m$^2$).

Film D

This film was the same as Film A except that the second layer contained Compound (6) of the present invention (amount of Compound (6) coated: $8.0\times10^{-5}$ mol/m$^2$).

Film E

This film was the same as Film D except that the amount of Compound (6) coated was changed to $4.0\times10^{-5}$ mol/m$^2$.

Film F

This film was the same as Film D except that the amount of Compound (6) coated was changed to $2.0\times10^{-5}$ mol/m$^2$.

Films A to F were each exposed to light through a wedge varying continuously in the gray density and then processed as follows:

| Processing Step | Time (min) | Temperature (°C.) |
|---|---|---|
| Color development | 3.5 | 33 |
| Bleach-fixing | 1.5 | 33 |
| Rinsing | 3 | 28–35 |

The composition of the processing solution used at each step is shown below.

| | |
|---|---|
| Color Developer | |
| Benzyl alcohol | 15 ml |
| Diethylenetriaminepentaacetic acid | 5 g |
| KBr | 0.4 g |
| $Na_2SO_3$ | 5 g |
| $Na_2CO_3$ | 30 g |
| Hydroxyamine sulfate (4-Amino-3-methyl-N—β-(methanesulfonamido)ethylaniline.3/2$H_2SO_4$) | 2 g |
| $H_2O$ | 4.5 g |
| Water to make | 1,000 ml (pH 10.1) |
| Bleach-Fixer | |
| Ammonium thiosulfate (70% by weight) | 150 ml |
| $Na_2SO_3$ | 5 g |
| Na[Fe(EDTA)] | 40 g |
| EDTA | 4 g |
| Water to make | 1,000 ml (pH 6.8) |

Each developed sample was measured for the density (magenta color density) by the use of a green filter. The magenta color mixing at yellow colored areas was examined by determining the difference between the magenta density at the maximum yellow color density and that at the minimum yellow color density. The results are shown in Table 1 below.

TABLE 1

| Film No. | Compound Type | Compound Amount (mol/m$^2$) | Color Mixing |
|---|---|---|---|
| A | — | — | 0.73 |
| B | Di-tert-octyl-hydroquinone | $1.59\times10^{-4}$ | 0.25 |
| C | (5) | $8.0\times10^{-5}$ | 0.18 |
| D | (6) | $8.0\times10^{-5}$ | 0.17 |
| E | (6) | $4.0\times10^{-5}$ | 0.21 |
| F | (6) | $2.0\times10^{-5}$ | 0.24 |

Although the amount of the compound of the present invention which is added is smaller, the color mixing caused is less. Thus, it can be seen that the compounds of the present invention are superior in preventing color mixing (color fog) and exhibit a sufficiently satisfactory color mixing-preventing activity even in small amounts.

EXAMPLE 2

The following materials, Films G, H, and I, were prepared and tested in the same manner as in Example 1.

Film G

This film was the same as Film A except that the second layer contained Polymer (a) of the present invention (amount of Polymer (a) coated: 0.09 g/m$^2$, or $1.59\times10^{-4}$ mol/m$^2$ (calculated as a sulfonamidophenol radical)).

Film H

This film was the same as Film A except that the second layer contained Polymer (b) of the present invention (amount of Polymer (b) coated, 0.106 g/m$^2$, or $1.59\times10^{-4}$ mol/m$^2$ (calculated as a sulfonamidophenol radical)).

Film I

This film was the same as Film A except that the second layer contained Polymer (b) of the present invention (amount of Polymer (b) coated: 0.053 g/m$^2$, or $8.0\times10^{-5}$ mol/m$^2$ (calculated as a sulfonamidophenol radical)).

The results are shown in Table 2 below.

TABLE 2

| Film No. | Compound Type | Compound Amount (mol/m$^2$) | Color Mixing |
|---|---|---|---|
| A | — | — | 0.73 |
| B | 2,5-Di-tert-octylhydroquinone | $1.59\times10^{-4}$ | 0.25 |
| G | (a) | " | 0.20 |
| H | (b) | " | 0.20 |
| I | (b) | $8.0\times10^{-5}$ | 0.23 |

Although the amount of the compound of the present invention is smaller, the color mixing caused is less. Thus, it can be seen that the compounds of the present invention are superior in preventing color mixing (color fog) and exhibit a sufficiently satisfactory color mixing-preventing activity even when used in small amounts.

EXAMPLE 3

Preparation of Paper A

A blue-sensitive silver chlorobromide emulsion (silver bromide: 70 mol%; silver chloride: 30 mol%) containing a yellow coupler, α-pivaloyl-α(2,4-dioxo-5,5'-dimethyloxazolizine-3-yl)-2-chloro-5-[α-(2,4-di-tertpentylphenoxy)butineamido]acetanilide, was coated on a polyethylene double-coated baryta paper support in a dry film thickness of 3μ (amount of the coupler coated: $0.646\times10^{-3}$ mol/m$^2$, amount of the silver coated: $3.88\times10^{-3}$ mol/m$^2$).

A gelatin layer was coated on the above-coated layer in a dry film thickness of 1μ.

In addition, the following materials, Papers B to E, were prepared.

Papers B to E

Papers B to E were prepared in the same manner as in Paper A except that in combination with the yellow coupler, Compounds (5), (6), (7), and (14) of the present invention, were used respectively, each in an amount of $0.02\times10^{-3}$ mol/m$^2$.

Each paper sample was exposed to light through a wedge varying continuously in the gray density and then processed in the same manner as in Example 1 except that the color development was performed at 38° C. for 3 minutes. After the processing, the yellow density was measured to determine the maximum density (Dmax) and the minimum density (Dmin). The results are shown in Table 3 below.

TABLE 3

| Paper No. | Compound | Dmax | Dmin |
|---|---|---|---|
| A | — | 2.13 | 0.25 |
| B | (5) | 2.03 | 0.20 |
| C | (6) | 2.07 | 0.21 |
| D | (7) | 1.98 | 0.20 |
| E | (14) | 2.04 | 0.21 |

It can be seen from Table 3 that Papers B to E containing the compounds of the present invention are low in minimum density compared with the Paper A and are improved in color fog over Paper A.

Papers A to E (which had not been exposed to light yet) were stored for 3 days under conditions of 50% relative humidity and 50° C. and then exposed to light and processed in the same manner as above. For Paper A, a reduction in maximum density and an increase in minimum density were observed, whereas in Papers B to E both the changes in maximum density and minimum density were very small.

EXAMPLE 4

Papers F to I were prepared in the same manner as in Paper A of Example 3 except that in addition to the yellow coupler, Polymers (a), (b), (c) and (d) of the present invention were added respectively, each in an amount of $0.02\times10^{-3}$ mol/m$^2$ (calculated as a sulfonamidophenol radical).

Each paper sample was tested in the same manner as Example 3. The results are shown in Table 4 below.

TABLE 4

| Paper No. | Polymer | Dmax | Dmin |
|---|---|---|---|
| A | — | 2.13 | 0.25 |
| F | (a) | 2.08 | 0.21 |
| G | (b) | 2.06 | 0.20 |
| H | (c) | 2.06 | 0.22 |
| I | (d) | 2.07 | 0.23 |

It can be seen from Table 4 that Papers F to I containing the compounds of the present invention are low in minimum density compared with Paper A and are improved in color fog over Paper A.

Papers A to I (which had not been exposed to light yet) were stored for 3 days under conditions of 50% relative humidity and 50° C., and then exposed to light and processed in the same manner as described above. For Paper A, a reduction in maximum density and an increase in minimum density were observed, whereas for Papers F to I both the changes in maximum density and minimum density were very small.

EXAMPLE 5

Preparation of Film A

The following layers, first layer to eleventh layer, were coated on a triacetyl cellulose support in that sequence.

First Layer (Low Sensitivity Red-Sensitive Emulsion Layer)

A cyan coupler, 2-heptafluorobutylamido-5-{2'-(2",4"-di-tert-aminophenoxy)butylamido}phenol (100 g) was dissolved in a mixed solvent of 100 ml of tricresyl phosphate and 100 ml of ethyl acetate, mixed with 1 kg of a 10% aqueous gelatin solution. Then, 500 g of the obtained cyan coupler emulsion is mixed with a red-sensitive low sensitivity silver iodobromide emulsion (containing 70 g of silver and 60 g of gelatin; iodine content: 4.5 mol%), and coated in a dry film thickness of 2μ.

Second Layer (High Sensitivity Red-Sensitive Emulsion Layer)

The same cyan coupler emulsion as used in the preparation of the first layer (1,000 g) was mixed with 1 kg of a red-sensitive high sensitivity silver iodobromide emulsion (containing 70 g of silver and 60 g of gelatin; iodine content: 4.5 mol%) and then coated in a dry film thickness of 2μ.

Third Layer (Intermediate Layer)

2,5-Di-tert-octylhydroquinone (50 g) was dissolved in a mixed solvent of 100 ml of dibutyl phthalate and 100 ml of ethyl acetate and then mixed with 1 kg of a 10% aqueous gelatin solution. The resulting mixture was stirred and emulsified to prepare an emulsion. Then, 700 g of the emulsion was mixed with 1 kg of 10% gelatin and coated in a dry film thickness of 1.2μ.

Fourth Layer (Low Sensitivity Green-Sensitive Emulsion Layer)

An emulsion was prepared in the same manner as in the preparation of the emulsion for the first layer except that a magenta coupler, 1-(2,4,6-trichlorophenyl)-3-{3-(2,4-di-tert-amylphenoxyacetamido)benzamido}-5-pyrazolone (125 g) was used. Five hundred grams of the thus-prepared emulsion was mixed with 1 kg of a green-sensitive silver iodobromide emulsion (containing 70 g of silver and 60 g of gelatin; iodine content: 2.5 mol%) and then coated in a dry film thickness of 2.0μ.

Fifth Layer (High Sensitivity Green-Sensitive Emulsion Layer)

The same magenta coupler emulsion as used in the preparation of the fourth layer (1,000 g) was mixed with 1 kg of a green-sensitive high sensitivity silver iodobromide emulsion (containing 70 g of silver and 60 g of gelatin; iodine content: 2.5 mol%) and coated in a dry film thickness of 2μ.

Sixth Layer (Intermediate Layer)

The same emulsion as used in the preparation of the third layer (700 g) was mixed with 1 kg of 10% gelatin and then coated in a dry film thickness of 0.9μ.

Seventh Layer (Yellow Filter Layer)

A gelatin solution containing yellow colloid silver was coated in a dry film thickness of 1μ.

Eighth Layer (Low Sensitivity Blue-Sensitive Emulsion Layer)

An emulsion was prepared in the same manner as in the preparation of the emulsion for the first layer except that 70 g of a yellow coupler, α-pivaloyl-α-(1-benzyl-5-ethoxy-3-hydantoyl)-2-chloro-5-dodecyloxycarbonylacetanilide was used. Eight hundred grams of the thus-prepared emulsion was mixed with 1 kg of a blue-sensitive silver iodobromide emulsion (containing 70 g of silver and 60 g of gelatin; iodine content: 2.5 mol%) and then coated in a dry film thickness of 2.0μ.

Ninth Layer (High Sensitivity Blue-Sensitive Emulsion Layer)

The same emulsion as used in the preparation of the eighth layer (1,000 g) was mixed with 1 kg of a blue-sensitive silver iodobromide emulsion (containing 70 g of silver and 60 g of gelatin; iodine content: 2.5 mol%) and then coated in a dry film thickness of 2.0μ.

Tenth Layer (Second Protective Layer)

The emulsion as used in the preparation of the third layer (1,000 g) was mixed with 1 kg of 10% gelatin and then coated in a dry film thickness of 1μ.

Eleventh Layer (First Protective Layer)

A 10% aqueous gelatin solution containing a finely divided silver iodobromide emulsion (grain size: 0.15μ; iodine content: 1 mol%) not chemically sensitized was coated in a dry film thickness of 1μ (amount of silver coated: 0.3 g/m$^2$).

In addition, the following films, Films B and C, were prepared.

Films B and C

These films were prepared in the same manner as in Film A except that the third layer, sixth layer and tenth layer were prepared using emulsions containing Compounds (5) and (6) of the present invention, respectively, in place of di-tert-octylhydroquinone.

Films A to C were each exposed to red light through a wedge varying continuously in the gray density and then subjected to the following reversal development.

| Processing Stop | Time (min) | Temperature (°C.) |
|---|---|---|
| First development | 6 | 38 |
| Rinsing | 2 | " |
| Reversion | 2 | " |
| Color development | 6 | " |
| Adjustment | 2 | " |
| Bleaching | 6 | " |
| Fixing | 4 | " |
| Rinsing | 4 | " |
| Stabilization | 1 | Ordinary temperature |
| Drying | | |

The composition of the processing solution used at each step is shown below.

| First Developer | |
|---|---|
| Water | 700 ml |

-continued

| | |
|---|---|
| Sodium tetrapolyphosphate | 2 g |
| Sodium sulfite | 20 g |
| Hydroquinone monosulfonate | 30 g |
| Sodium carbonate (monohydrate) | 30 g |
| 1-Phenyl-4-methyl-4-hydroxymethyl-3-pyrazolidone | 2 g |
| Potassium bromide | 2.5 g |
| Potassium thiocyanate | 1.2 g |
| Potassium iodide (0.1% solution) | 2 ml |
| Water to make | 1,000 ml (pH 10.1) |
| Reversion Solution | |
| Water | 700 ml |
| Nitrilo-N,N,N—trimethylene phosphonic acid 6Na salt | 3 g |
| Stannous chloride (dihydrate) | 1 g |
| p-Aminophenol | 0.1 g |
| Sodium hydroxide | 8 g |
| Glacial acetic acid | 15 ml |
| Water to make | 1,000 ml |
| Color Developer | |
| Water | 700 ml |
| Sodium tetrapolyphosphate | 2 g |
| Sodium sulfite | 7 g |
| Sodium triphosphate (12 hydrate) | 36 g |
| Potassium bromide | 1 g |
| Potassium iodide (0.1% solution) | 90 ml |
| Sodium hydroxide | 3 g |
| Citrazinic acid | 15 g |
| N—Ethyl-N—(β-methanesulfonamidoethyl)-3-methyl-4-aminoaniline sulfate | 11 g |
| Ethylenediamine | 3 g |
| Water to make | 1,000 ml |
| Adjusting Solution | |
| Water | 700 ml |
| Sodium sulfite | 12 g |
| Sodium ethylenediaminetetraacetate (2 hydrate) | 8 g |
| Thioglycerine | 0.4 ml |
| Glacial acetic acid | 3 ml |
| Water to make | 1,000 ml |
| Bleaching Solution | |
| Water | 800 ml |
| Sodium ethylenediaminetetraacetate (2 hydrate) | 2.0 g |
| Ammonium iron (III) ethylenediaminetetraacetate (2 hydrate) | 120.0 g |
| Potassium bromide | 100.0 g |
| Water to make | 1,000 ml |
| Fixer | |
| Water | 800 ml |
| Ammonium thiosulfate | 80.0 g |
| Sodium sulfite | 5.0 g |
| Sodium hydrogensulfite | 5.0 g |
| Water to make | 1,000 ml |
| Stabilizer | |
| Water | 800 ml |
| Formalin (37% by weight) | 5.0 ml |
| Fuji dry well | 5.0 ml |
| Water to make | 1,000 ml |

Each developed film was measured for density by the use of a red filter to determine the maximum color density (Dmax) and minimum color density (Dmin). Furthermore, the blue-sensitive layer and green-sensitive layer were measured for the maximum color density by the use of a blue filter and a green filter, respectively. The results are shown in Table 5 below.

TABLE 5

| Film No. | Red-Sensitive Layer Dmax | Red-Sensitive Layer Dmin | Green-Sensitive Layer Dmax | Blue-Sensitive Layer Dmax |
|---|---|---|---|---|
| A (comparison) | 2.98 | 0.43 | 2.63 | 2.85 |
| B (this invention) | 2.80 | 0.38 | 2.54 | 2.73 |
| C (this invention) | 2.84 | 0.37 | 2.55 | 2.76 |

It can be seen from Table 5 that when the compounds of the present invention are used, the minimum density of the red-sensitive layer drops. This demonstrates that color stain is prevented by using the compounds of the present invention.

EXAMPLE 6

The following layers were provided on a triacetyl cellulose support to prepare a multi-layer color (negative) light-sensitive material.

First Layer (Antihalation Layer)

Dry film thickness: 2.0μ

Second Layer (Low Sensitivity Red-Sensitive Emulsion Layer)

Four hundred grams of Emulsion (1) containing a cyan coupler as described hereinafter (containing 70 g of the cyan coupler and 100 g of gelatin), 200 g of Emulsion (2) containing the same cyan coupler as used above and a DIR compound as described hereinafter (containing 70 g of the cyan coupler, 10 g of the DIR compound, and 100 g of gelatin), and 200 ml of a 2% aqueous solution of a colored cyan coupler as described hereinafter were mixed with 1 kg of a low sensitivity red-sensitive silver iodobromide emulsion (containing 100 g of silver halide and 70 g of gelatin; iodine content: 5.0 mol%) and then coated in a dry film thickness of 3.5μ.

Cyan Coupler

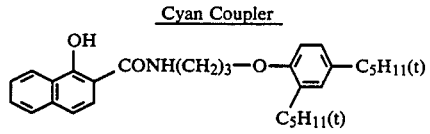

DIR Compound

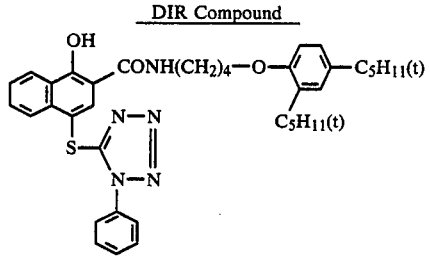

Colored Cyan Coupler

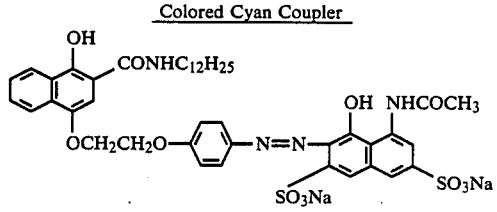

Third Layer (High Sensitivity Red-Sensitive Emulsion Layer)

Two hundred twenty grams of Emulsion (1) used in the above second layer, 30 g of Emulsion (2) used in the above second layer, and 200 ml of a 2% aqueous solution of colored cyan coupler, all being the same as used in the preparation of the second layer, were mixed with 1 kg of a high sensitivity red-sensitive silver iodobromide emulsion (containing 100 g of silver halide and 70 g of gelatin; iodine content: 5 mol%) and then coated in a dry film thickness of 2.2μ.

Fourth Layer (Gelatin Intermediate Layer)

2,5-Di-tert-octylhydroquinone (50 g) was dissolved in a mixed solvent of 100 ml of dibutyl phthalate and 100 ml of ethyl acetate, and emulsified in 1 kg of a 10% aqueous gelatin solution. Then, 700 g of the thus-prepared emulsion was mixed with 1 kg of a 10% aqueous gelatin solution and then coated in a dry film thickness of 1.2μ.

Fifth Layer (Low Sensitivity Green-Sensitive Emulsion Layer)

Three hundred twenty grams of Emulsion (3) containing 50 g of a magenta coupler as described hereinafter and 10 g of a colored magenta coupler as described hereinafter (gelatin content: 100 g) and 180 g of Emulsion (4) containing 50 g of the same magenta coupler as used above, 10 g of the same colored magenta coupler as used above, and 15 g of a DIR compound as described hereinafter (gelatin content: 100 g) were mixed with 1 kg of a low sensitivity green-sensitive silver iodobromide emulsion (containing 100 g of silver halide and 70 g of gelatin; iodine content: 5 mol%) and then coated in a dry film thickness of 3.2μ.

Magenta Coupler

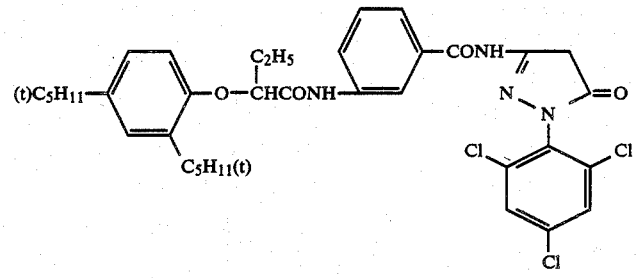

Colored Magenta Coupler

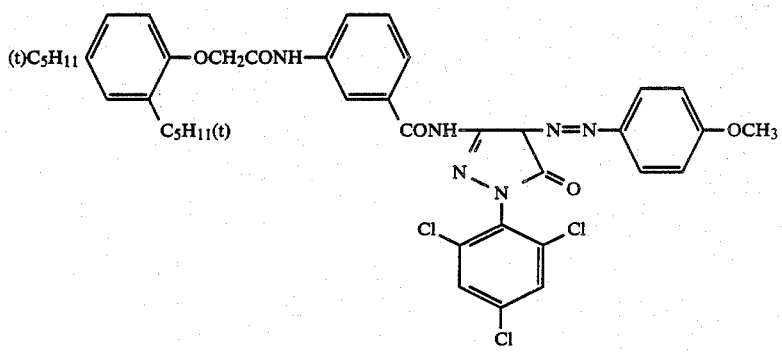

DIR Compound

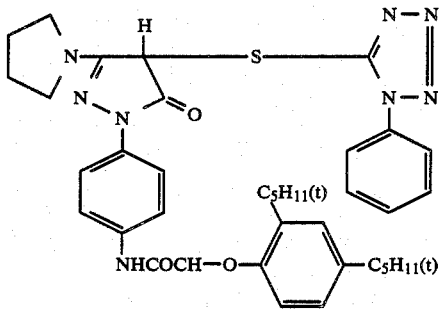

Sixth Layer (High Sensitivity Green-Sensitive Emulsion Layer)

One hundred fifty grams of Emulsion (3) and 30 g of Emulsion (4), both being the same as used in the preparation of the second layer, were mixed with 1 kg of a high sensitivity green-sensitive silver iodobromide emulsion (containing 100 g of silver halide and 70 g of gelatin; iodine content: 5 mol%) and then coated in a dry film thickness of 2.2μ.

Seventh Layer (Gelatin Intermediate Layer)

An aqueous gelatin solution was coated in a dry film thickness of 0.9μ.

Eighth Layer (Yellow Filter Layer)

A gelatin solution containing yellow colloid silver was coated in a dry film thickness of 1μ.

Ninth Layer (Low Sensitivity Blue-Sensitive Emulsion Layer)

One hundred fifty grams of Emulsion (5) containing 100 g of a yellow coupler as described hereinafter and 100 g of gelatin was mixed with 1 kg of a low sensitivity blue-sensitive silver iodobromide emulsion (containing 100 g of silver halide and 70 g of gelatin; iodine content: 5 mol%) and then coated in a dry film thickness of 3.0μ.

Yellow Coupler

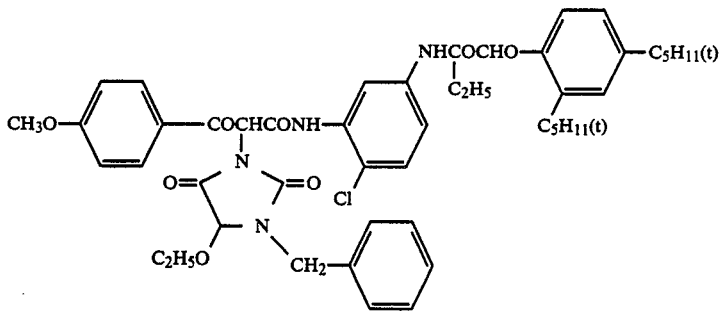

Tenth Layer (High Sensitivity Blue-Sensitive Emulsion Layer)

Three hundred grams of Emulsion (5) as used in the preparation of the ninth layer was mixed with 1 kg of a high sensitivity blue-sensitive silver iodobromide emulsion (containing 100 g of silver halide and 70 g of gelatin; iodine content: 5 mol%) and then coated in a dry film thickness of 2.5μ.

Eleventh Layer (Second Protective Layer)

Dry film thickness: 1μ

Twelfth Layer (Gelatin Protective Layer)

Dry film thickness: 1.5μ

The above-prepared film sample is referred to as "Film A".

Film B was prepared in the same manner as above except that in the emulsion for the preparation of the fourth layer, the 2,5-di-tert-octylhydroquinone was replaced by Polymer (a) of the present invention (amount as calculated as a sulfoneamidophenol radical: $1.59\times10^{-4}$ mol/m$^2$).

Each film sample was exposed to red light through a wedge varying continuously in the gray density and then processed as follows:

| Processing Step | Time (min) |
|---|---|
| 1. Color development | 3.25 |
| 2. Prebath | 0.5 |
| 3. Bleaching | 4 minutes 20 seconds |
| 4. Fixing | " |
| 5. Rinsing | 3.25 |
| 6. Stabilization | 0.5 |

The composition of the processing solution used at each step was as follows:

| | |
|---|---|
| Color Developer | |
| Trisodium nitrilotriacetate | 1.9 g |
| Sodium sulfite | 4.0 g |
| Potassium carbonate | 30.0 g |
| Potassium bromide | 1.4 g |
| Potassium iodide | 1.3 mg |
| Hydroxylamine sulfate | 2.4 g |
| 4-(N—Ethyl-N—β-hydroxyethyl-amino)-2-methylaniline sulfate | 4.5 g |
| Water to make | 1,000 ml |
| Bleaching Solution | |
| Ammonium iron (III) ethylenediamine-tetraacetate | 100.0 g |
| Disodium ethylenediaminetetraacetate | 8.0 g |
| Ammonium bromide | 150.0 g |
| Water to make | 1,000 ml (pH 6.0) |
| Fixer | |
| Sodium tetrapolyphosphate | 2.0 g |
| Sodium sulfite | 4.0 g |
| Aqueous solution of ammonium thiosulfate (70%) | 175.0 ml |
| Sodium bicarbonate | 4.6 g |
| Water to make | 1,000 ml (pH 6.6) |
| Stabilizer | |
| Formalin (40%) | 8.0 ml |
| Water to make | 1,000 ml |

The thus-developed Films A and B were measured for the density by the use of a green filter to determine the maximum color density and minimum color density of the green-sensitive layer. This measurement showed that the magenta color density of Film B containing the compound of the present invention was lower than that of Film A and the color mixing was prevented in Film B more than in Film A.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material containing: a color stain inhibitor which is a polymer containing a group represented by general formula (I) or (II) as a pendant:

Formula (I)

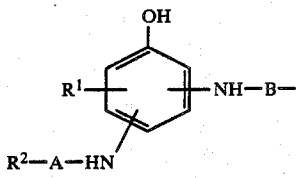

Formula (II)

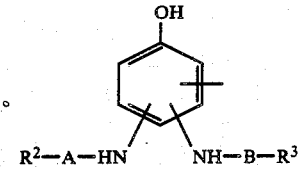

wherein:

A and B are each —CO— or —$SO_2$—, provided that at least one of A and B is —$SO_2$—;

$R^1$ is selected from the group consisting of a hydrogen atom, a halogen atom, and a substituted or unsubstituted group selected from the group consisting of an alkyl group, an alkoxyl group, an arylsulfonamide group, an alkylsulfonamide group, an acylamino group, an alkylthio group, an arylthio group, a heterocyclic thio group, an alkoxycarbonyl group, an aryloxycarbonyl group, a sulfamoylamino group, an alkoxycarbonylamino group, a carbamoylamino group, an acyl group, a sulfonyl group, and a carbamoyl group;

$R^2$ and $R^3$ is a substituted or unsubstituted group selected from the group consisting of an aryl group, an alkyl group, and an amino group, and wherein $R^2$ and $R^3$ may be the same or different; and wherein the polymer containing a group represented by general formula (I) or (II) as a pendant is a polymer having a repeating unit represented by general formula (V) or (VI):

Formula (V)

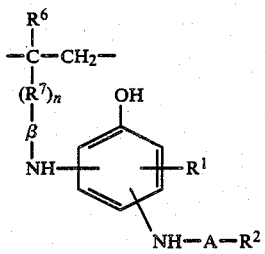

Formula (VI)

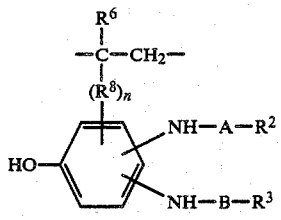

wherein:

A, B, $R^1$, $R^2$, and $R^3$ are as defined in general formula (I) or (II);

$R^7$ and $R^8$ are each a divalent connecting group;

n is 0 or 1; and $R^6$ is selected from the group consisting of a hydrogen atom, a halogen atom, and an alkyl group, wherein said polymer does not form color by oxidative coupling with color developing agents during color development.

2. The material as claimed in claim 1, wherein A and B in general formula (I) or (II) are both —$SO_2$—.

3. The material as claimed in claim 1, wherein A and B in general formula (I) or (II) are both —$SO_2$—.

4. The material as claimed in claim 1, wherein the polymer containing a group represented by the general formula (I) or (II) as a pendant has a molecular weight of about 5,000 to 100,000.

* * * * *